US012569066B2

(12) United States Patent
Sun et al.

(10) Patent No.: US 12,569,066 B2
(45) Date of Patent: Mar. 10, 2026

(54) SEAT FRAME AND SEAT WITH SWITCHABLE SITTING AND LYING POSITIONS

(71) Applicant: HAINING HELI MACHINERY & TECHNOLOGY CO., LTD., Jiaxing (CN)

(72) Inventors: Xiqi Sun, Jiaxing (CN); Qiu Xu, Jiaxing (CN); Junjun Dai, Jiaxing (CN); Mengjie Li, Jiaxing (CN)

(73) Assignee: HAINING HELI MACHINERY & TECHNOLOGY CO., LTD., Jaixing (CN)

( * ) Notice: Subject to any disclaimer, the term of this patent is extended or adjusted under 35 U.S.C. 154(b) by 156 days.

(21) Appl. No.: 18/649,358

(22) Filed: Apr. 29, 2024

(65) Prior Publication Data

US 2024/0374032 A1 Nov. 14, 2024

(30) Foreign Application Priority Data

May 8, 2023 (CN) ..... 202321106484.9

(51) Int. Cl.
*A47C 1/0355* (2013.01)
*A47C 1/032* (2006.01)

(52) U.S. Cl.
CPC ..... *A47C 1/0355* (2013.01); *A47C 1/03211* (2013.01)

(58) Field of Classification Search
CPC ... A47C 1/0242; A47C 1/032; A47C 1/03211; A47C 1/0355
See application file for complete search history.

(56) References Cited

U.S. PATENT DOCUMENTS 4,815,788 A * 3/1989 May ..... A47C 1/0355 297/85 L
5,072,988 A * 12/1991 Plunk ..... A47C 1/0352 297/85 L
5,186,518 A * 2/1993 Pine ..... A47C 1/0355 297/85 L
5,292,170 A * 3/1994 LaPointe ..... A47C 1/0352 297/68
5,374,101 A * 12/1994 Wiecek ..... A47C 1/0355 297/75

(Continued)

FOREIGN PATENT DOCUMENTS

CA 2539013 A1 * 9/2007 ..... A47C 1/0355
CN 106073249 A * 11/2016 ..... A47C 1/0242

(Continued)

*Primary Examiner* — Brian M O'Hara
*Assistant Examiner* — Michael B. Kreiner

(57) ABSTRACT

A seat frame and a seat with switchable sitting and lying positions are provided. The seat frame includes a frame, a seat cushion, and a backrest connecting rod mechanism with a polygonal planar structure, the polygonal planar structure includes a front swing arm, a back pole frame, and a T-shaped connecting rod. A front end of the back pole frame is hinged to the upper end of the front swing arm. The T-shaped connecting rod includes two straight rods; an end of one of the two straight rods is defined as a first protruding end hinged to the lower end of the front swing arm, an end of the other of the two straight rods is defined as a second protruding end hinged to a back end of the back pole frame.

20 Claims, 13 Drawing Sheets

(56) References Cited

U.S. PATENT DOCUMENTS 5,419,611 A * 5/1995 Cook ..... A47C 1/0355 297/75
5,570,927 A * 11/1996 LaPointe ..... A47C 1/0355 297/85 L
5,588,710 A * 12/1996 Wiecek ..... A47C 1/0355 297/85 L
5,772,278 A * 6/1998 Kowalski ..... A47C 1/0355 297/85 L
5,823,614 A * 10/1998 Johnson ..... A47C 1/0352 297/452.4
5,971,475 A * 10/1999 Lawson ..... A47C 1/0355 297/68
6,000,754 A * 12/1999 Lawson ..... A47C 1/0355 297/DIG. 7
6,135,559 A * 10/2000 Kowalski ..... A47C 1/024 297/301.5
6,142,558 A * 11/2000 May ..... A47C 1/0355 297/75
6,644,733 B1 * 11/2003 Tseng ..... A47C 1/0355 297/90
7,021,711 B1 * 4/2006 Hoffman ..... A47C 3/027 297/270.3
7,040,692 B1 * 5/2006 Pine ..... A47C 3/027 297/85 L
7,114,770 B2 * 10/2006 Murphy ..... A47C 1/0355 297/423.26
7,147,278 B2 * 12/2006 Johnson ..... A47C 1/0352 297/85 R
7,357,450 B2 * 4/2008 Rogers ..... A47C 1/0355 297/85 L
7,396,074 B2 * 7/2008 Wiecek ..... A47C 1/0355 297/85 L
7,445,278 B2 * 11/2008 Wiecek ..... A47C 1/0355 297/69
7,497,512 B2 * 3/2009 White ..... A47C 1/0355 297/89
7,766,421 B2 * 8/2010 Lawson ..... A47C 1/0355 297/85 M
7,997,644 B2 * 8/2011 Hoffman ..... A47C 3/0255 297/344.21
8,016,348 B2 * 9/2011 Hoffman ..... A47C 3/0255 297/85 M
8,123,288 B2 * 2/2012 Murphy ..... A47C 1/0355 297/DIG. 7
8,123,289 B2 * 2/2012 Qiu ..... A47C 1/0355 297/68
8,398,165 B2 * 3/2013 Lawson ..... A47C 3/027 297/259.2
8,398,168 B2 * 3/2013 Lawson ..... A47C 1/0355 297/259.2
8,398,169 B2 * 3/2013 LaPointe ..... A47C 1/0355 297/260.2
8,459,732 B2 * 6/2013 LaPointe ..... A47C 3/02 297/260.2
8,506,009 B2 * 8/2013 LaPointe ..... A47C 1/0355 297/85 M
8,517,463 B2 * 8/2013 Murphy ..... A47C 1/0355 297/69
8,573,687 B2 * 11/2013 Lawson ..... A47C 1/0342 297/90
8,616,627 B2 * 12/2013 Murphy ..... A47C 1/0355 297/85 L
8,696,053 B2 * 4/2014 LaPointe ..... A47C 1/0355 297/85 M
8,696,054 B2 * 4/2014 Crum ..... A47C 1/0355 297/85 M
8,727,433 B2 * 5/2014 Lawson ..... A47C 1/0355 297/DIG. 10
8,845,014 B2 * 9/2014 Wong ..... A47C 17/04 297/85 C
9,050,231 B2 * 6/2015 Masters ..... A61G 5/14
9,314,099 B2 * 4/2016 Huang ..... A47C 1/0355
9,332,844 B2 * 5/2016 Regev ..... A47C 3/025
9,351,576 B1 * 5/2016 Rogers ..... A47C 1/0355
9,386,857 B2 * 7/2016 Lawson ..... A47C 1/0355
9,398,810 B2 * 7/2016 Donovan ..... A47C 1/0342
9,433,295 B2 * 9/2016 Crum ..... A47C 7/5068
9,468,295 B2 * 10/2016 Lawson ..... A47C 1/0355
9,585,477 B2 * 3/2017 Huang ..... A47C 1/0342
9,635,943 B2 * 5/2017 Lawson ..... A47C 7/506
9,700,140 B2 * 7/2017 Lawson ..... A47C 1/0345
9,756,949 B2 * 9/2017 Huang ..... A47C 17/04
9,844,269 B2 * 12/2017 Bryant ..... A47C 1/0242
9,845,852 B2 * 12/2017 Lawson ..... A47C 1/0355
9,962,004 B2 * 5/2018 Bryant ..... A47C 1/0355
9,980,576 B2 * 5/2018 Huang ..... A47C 20/12
10,258,158 B2 * 4/2019 Fei ..... A61G 5/04
10,278,510 B2 * 5/2019 Lawson ..... A47C 7/506
10,299,596 B2 * 5/2019 White ..... A47C 1/0355
10,299,597 B1 * 5/2019 Crum ..... A47C 1/0355
10,327,553 B2 * 6/2019 Kiwak ..... A47C 3/0251
10,349,745 B2 * 7/2019 Huang ..... A47C 1/0355
10,376,060 B2 * 8/2019 Marcantoni ..... A47C 1/0342
10,383,442 B2 * 8/2019 Lawson ..... A47C 1/0345
10,383,443 B2 * 8/2019 Lawson ..... A47C 7/002
10,420,422 B2 * 9/2019 Lawson ..... A47C 1/0355
10,426,266 B2 * 10/2019 Wu ..... A47C 17/04
10,441,081 B2 * 10/2019 Carrera ..... A47C 1/024
10,485,719 B2 * 11/2019 Murphy ..... A47C 1/0242
10,575,644 B2 * 3/2020 Bryant ..... A47C 1/0355
10,602,854 B2 * 3/2020 Gu ..... A47C 7/52
10,653,243 B2 * 5/2020 Lawson ..... A47C 1/03211
10,682,271 B2 * 6/2020 Lin ..... A47C 7/5068
10,842,273 B2 * 11/2020 Fei ..... A47C 1/0355
10,842,274 B1 * 11/2020 Crawford ..... A47C 1/0345
10,932,570 B2 * 3/2021 Crawford ..... A47C 1/03211
10,986,923 B2 * 4/2021 Kachirski ..... A47C 1/0355
11,166,562 B2 * 11/2021 Zhang ..... A61G 5/14
11,219,314 B2 * 1/2022 Zhang ..... A47C 1/0355
11,229,290 B1 * 1/2022 Bryant ..... A47C 7/004
11,266,245 B2 * 3/2022 Lawson ..... A47C 1/0355
11,297,947 B2 * 4/2022 Murphy ..... A47C 1/03211
11,363,886 B2 * 6/2022 Johnson ..... A47C 1/03211
11,388,998 B2 * 7/2022 Murphy ..... A47C 1/03272
11,406,191 B2 * 8/2022 Chen ..... A47C 1/0355
11,439,234 B2 * 9/2022 Zhang ..... A47C 1/03211
11,452,378 B1 * 9/2022 Li ..... A47C 1/03211
11,470,968 B1 * 10/2022 Sha ..... A47C 1/034
11,517,109 B2 * 12/2022 Browning ..... A47C 1/03211
11,540,632 B2 * 1/2023 Zhang ..... A61G 5/14
11,540,633 B2 * 1/2023 Zhang ..... A47C 1/0355
11,564,497 B2 * 1/2023 Sha ..... A47C 1/03211
11,564,498 B1 * 1/2023 Li ..... A47C 17/04
11,583,083 B2 * 2/2023 Schuster ..... A47C 1/0355
11,583,084 B2 * 2/2023 Loccioni ..... A47C 3/0251
11,617,446 B2 * 4/2023 Zhang ..... A47C 7/5068 297/423.26
11,638,483 B2 * 5/2023 Sun ..... A47C 1/03211 297/75
11,678,745 B2 * 6/2023 Zou ..... A47C 1/03211 297/259.2
11,690,453 B2 * 7/2023 Zhang ..... A47C 1/032 297/330
11,700,942 B2 * 7/2023 Li ..... A47C 17/04 297/85 R
11,744,368 B2 * 9/2023 Li ..... A47C 3/0255 297/84
11,766,123 B2 * 9/2023 Feng ..... A47C 17/04 297/68
11,766,124 B2 * 9/2023 Crawford ..... A47C 1/0355 297/85 R
11,839,303 B2 * 12/2023 Sun ..... A47C 1/035
11,903,485 B1 * 2/2024 Lawson ..... A47C 1/0355
12,082,698 B2 * 9/2024 Liu ..... A47C 1/0345
12,178,325 B2 * 12/2024 Li ..... A47C 1/0355
12,207,731 B2 * 1/2025 Yang ..... A47C 17/163
12,239,240 B2 * 3/2025 Li ..... A47C 7/144
12,310,509 B2 * 5/2025 Liu ..... A47C 3/029
12,408,754 B2 * 9/2025 Li ..... A47C 1/0347
12,453,422 B2 * 10/2025 Lake ..... A47C 1/03211

(56) References Cited

U.S. PATENT DOCUMENTS

| | | | | |
|---|---|---|---|---|
| 12,458,145 | B2 * | 11/2025 | Thorwesten | A47C 1/0242 |
| 2013/0234477 | A1 * | 9/2013 | Sichelschmidt | A47C 1/034 297/68 |
| 2014/0132038 | A1 * | 5/2014 | Lu | A47C 1/035 297/68 |
| 2017/0311729 | A1 * | 11/2017 | Xu | A47C 20/10 |
| 2022/0087431 | A1 * | 3/2022 | Zhang | A47C 7/5068 |
| 2024/0090668 | A1 * | 3/2024 | Li | A47C 1/0355 |
| 2024/0138569 | A1 * | 5/2024 | Murphy | A47C 3/0255 |
| 2024/0148145 | A1 * | 5/2024 | Li | A47C 1/0355 |
| 2024/0156262 | A1 * | 5/2024 | Li | A47C 1/0355 |
| 2024/0164527 | A1 * | 5/2024 | Li | A47C 7/5068 |
| 2024/0164532 | A1 * | 5/2024 | Li | A47C 1/0355 |
| 2024/0215726 | A1 * | 7/2024 | Li | A47C 1/0345 |
| 2024/0277145 | A1 * | 8/2024 | Li | A61G 5/14 |
| 2024/0315452 | A1 * | 9/2024 | Bryant | A47C 1/0355 |
| 2024/0315453 | A1 * | 9/2024 | Bryant | A47C 1/03211 |
| 2024/0365979 | A1 * | 11/2024 | Lawson | A47C 1/0355 |
| 2025/0057317 | A1 * | 2/2025 | Zhou | A47C 17/86 |
| 2025/0082099 | A1 * | 3/2025 | Ye | A47C 1/03211 |
| 2025/0151906 | A1 * | 5/2025 | Yang | A47C 1/0355 |
| 2025/0151908 | A1 * | 5/2025 | Lei | A47C 1/0355 |
| 2025/0160521 | A1 * | 5/2025 | Cai | A47C 1/0345 |
| 2025/0228368 | A1 * | 7/2025 | Wang | A47C 1/03211 |
| 2025/0261757 | A1 * | 8/2025 | Crum | A47C 1/03211 |
| 2025/0338963 | A1 * | 11/2025 | Li | A47C 1/0345 |

FOREIGN PATENT DOCUMENTS

| | | | | | |
|---|---|---|---|---|---|
| CN | 106419215 | A | * | 2/2017 | A47C 7/00 |
| CN | 107157164 | A | * | 9/2017 | A47C 7/506 |
| CN | 107874503 | A | * | 4/2018 | A47C 1/03211 |
| CN | 108260984 | A | * | 7/2018 | A47C 17/163 |
| CN | 108402744 | A | * | 8/2018 | A47C 1/03211 |
| CN | 108771372 | A | * | 11/2018 | A47C 7/00 |
| CN | 109924748 | A | * | 6/2019 | A47C 1/0355 |
| CN | 110051153 | A | * | 7/2019 | A47C 17/86 |
| CN | 211048882 | U | * | 7/2020 | |
| CN | 112754210 | A | * | 5/2021 | A47C 7/5068 |
| CN | 216020115 | U | * | 3/2022 | |
| WO | WO-2015066943 | A1 | * | 5/2015 | A47C 3/18 |
| WO | WO-2018211395 | A1 | * | 11/2018 | A47C 1/0355 |
| WO | WO-2022241984 | A1 | * | 11/2022 | A47C 3/18 |
| WO | WO-2022252747 | A1 | * | 12/2022 | A47C 1/0345 |

* cited by examiner

SEAT FRAME AND SEAT WITH SWITCHABLE SITTING AND LYING POSITIONS

CROSS-REFERENCE TO RELATED APPLICATION

This application claims priority to Chinese patent application No. 202321106484.9, filed on May 8, 2023, and titled "SEAT FRAME AND SEAT WITH SWITCHABLE SITTING AND LYING POSITIONS". The content of the above identified application is hereby incorporated herein in its entirety.

TECHNICAL FIELD

The present disclosure relates to the field of seat technology, and in particular, to a seat frame and a seat with switchable sitting and lying positions.

BACKGROUND

Many seats with adjustable sitting position of users have been introduced in market. A seat frame of such seats can be switched to three states: a regular sitting position, a leisure position and a lying position. The seat frame in these three states has different shapes corresponding to three different use states respectively. The seat frame includes a seat cushion for carrying human buttocks, a backrest mechanism for supporting human back, and a frame for installing the seat cushion and a backrest mechanism.

Providing the seat frame switching the leisure position to the lying position as an example, shape changes of the seat frame include: the seat cushion moves forward relative to the frame to adapt to a change of a position of a center of gravity of the human body, and the backrest mechanism moves forward with the seat cushion and rotates backward relative to the seat cushion to increase an included angle between the seat cushion and the backrest mechanism. A forward movement of the seat cushion aims to ensure a stability of the seat frame, and a forward movement and a rotation of the backrest mechanism facilitate the user to lie on the backrest mechanism.

At present, problems existing in the seat frame are: a displacement of a forward movement of the backrest mechanism is insufficient, and the forward movement of the backrest mechanism lags behind a forward movement of the seat cushion when the seat frame is switched from the leisure position to the lying position, and waist of user is suspended in the lying position, lacking an effective support of the backrest mechanism. Even more difficult, when the seat is placed adjacent to the wall, if the seat frame state is switched to the lying position, the backrest mechanism will interfere with the wall, and the user has to temporarily move the seat.

SUMMARY

According to various embodiments of the present disclosure, a seat frame is provided.

A seat frame includes a frame, a seat cushion suspended above the frame and movably connected to the frame, and a backrest connecting rod mechanism with a polygonal planar structure, the polygonal planar structure includes:

a front swing arm, wherein the seat cushion is hinged between an upper end of the front swing arm and a lower end of the front swing arm;

a back pole frame, wherein a front end of the back pole frame is hinged to the upper end of the front swing arm; and a T-shaped connecting rod, wherein the T-shaped connecting rod includes two straight rods which are hinged to each other, and an included angle between the two straight rods can be adjusted;

an end of one of the two straight rods is defined as a first protruding end hinged to the lower end of the front swing arm, and an end of the other of the two straight rods is defined as a second protruding end hinged to a back end of the back pole frame, and one of the two straight rods includes a top end movably connected to the frame; and the seat cushion is capable of moving relative to the frame along a preset trajectory in a plane parallel to the polygonal planar structure.

In a process of the seat frame switching from a sitting position to a leisure position, and then from the leisure position to the lying position, the polygonal planar structure successively experiences morphological changes from a contraction state to an incomplete extension state and from the incomplete extension state to a complete extension state. The polygonal planar structure realizes a purpose of increasing an included angle between the back pole frame and the seat cushion through the above stretching deformation. During this period, the front swing arm rotates around the seat cushion and its own hinge point, which not only realizes an angle change of the front swing arm relative to the frame, but also greatly drives the back pole frame forward. The T-shaped connecting rod drives the back pole frame to rotate backward significantly with an angle change of the front swing arm, which realizes the back pole frame to rotate from an upright state to a lying state.

The seat frame of the present disclosure includes at least following beneficial effects:

1) a forward movement of the polygonal planar structure relative to the frame is obviously greater than that of the seat cushion, which will not give users a feeling that the forward movement of a backrest lags behind that of the seat cushion. The forward movement of the polygonal planar structure enables the back pole frame to move forward significantly relative to the frame, which enables the back pole frame to occupy a space below of a waist of the user in time during the switching position state to a lying position state, thus the back pole frame supports the waist of the user more fully;

2) the forward movement of the polygonal planar structure has exchanged more rotating space for the backrest to rotate from the upright state to the lying state, so an increase of the forward movement of the polygonal planar structure has improved the problem of interference between the backrest and the wall caused by the seat being placed adjacent to the wall. The back pole frame can move forward with the polygonal planar structure, so the back pole frame can avoid and stay away from the wall in time, thus allowing the seat to be placed adjacent to the wall in sitting position or leisure position and reducing an occupied area of a seat indoors; and 3) an arrangement of the T-shaped connecting rod simplifies the polygonal planar structure, and a shape and a structure of each bar constituting the polygonal planar structure are simpler, and a processing and a molding are convenient. A force transmission performance of the polygonal planar structure and a smoothness of active deformation are improved, and stressed parts of the polygonal planar structure are concentrated in hinged joints between bars during an active deformation process, thus reducing a possibility of lateral bending or torsional deformation of the bars. Therefore, the seat frame can still ensure that the back pole frame can be driven accurately after long-term use, and avoid a situation that the polygonal planar structure is blocked or loose.

In some embodiments, the two straight rods are denoted as:

a first micro-motion lever frame, wherein a front end of the first micro-motion lever frame is defined as the first protruding end, and a back end of the first micro-motion lever frame is defined as the top end; and a first back swing arm, wherein an upper end of the first back swing arm is defined as the second protruding end, and a lower end of the first back swing arm is hinged between the front end of the first micro-motion lever frame and the back end of the first micro-motion lever frame.

In some embodiments, the backrest connecting rod mechanism further includes a V-shaped connecting structure, the V-shaped connecting structure includes:

a lower swing arm, wherein the lower swing arm is hinged to the frame; and a first transition straight rod, wherein a lower end of the first transition straight rod is hinged to the lower swing arm, and an upper end of the first transition straight rod is hinged to the seat cushion;

the back end of the first micro-motion lever frame is hinged between the upper end of the first transition straight rod and the lower end of the first transition straight rod.

With this arrangement, the V-shaped connecting structure is connected to the first micro-motion lever frame to input power for a rotation of the front swing arm and a rotation of the first back swing arm, thus realizing a synchronous extension and a deformation of the polygonal planar structure following a motion of the seat cushion.

In some embodiments, the first micro-motion lever frame and the first transition straight rod are hinged at a first transition hinge point; and the first transition hinge point, a hinge point at the lower end of the first back swing arm, a hinge point at the upper end of the first back swing arm and a hinge point at the upper end of the first transition straight rod are connected in sequence to form a quadrilateral parallel to the polygonal planar structure.

In some embodiments, the first back swing arm and the first micro-motion lever frame are hinged at a first middle hinge point, a distance between the first middle hinge point and the hinge point at the front end of the first micro-motion lever frame is defined as S1, a distance between the first middle hinge point and the hinge point at the back end of the first micro-motion lever frame is defined as S2, and the distance S1 between the first middle hinge point and the hinge point at the front end of the first micro-motion lever frame and the distance S2 between the first middle hinge point and the hinge point at the back end of the first micro-motion lever frame satisfy following formula: $S1>S2$.

In some embodiments, a distance between the first transition hinge point and the hinge point at the upper end of the first transition straight rod is defined as Q1, and a distance between the first transition hinge point and the hinge point at the lower end of the first transition straight rod is defined as Q2, and the distance Q1 between the first transition hinge point and the hinge point at the upper end of the first transition straight rod and the distance Q2 between the first transition hinge point and the hinge point at the lower end of the first transition straight rod satisfy following formula: $Q1<Q2$.

In some embodiments, a length of a connecting line between the hinge point of the upper end of the first back swing arm and the hinge point of the lower end of the first back swing arm is defined as R1, a length of a connecting line between the hinge point at the upper end of the first transition straight rod and the first transition hinge point is defined as R2, a length of a connecting line between the first transition hinge point and the first middle hinge point is defined as R3, the length R1 of the connecting line between the hinge point of the upper end of the first back swing arm and the hinge point of the lower end of the first back swing arm, the length R2 of the connecting line between the hinge point at the upper end of the first transition straight rod and the first transition hinge point, and the length R3 of the connecting line between the first transition hinge point and the first middle hinge point satisfy following formula: $R1>R2$, and $R1>R3$.

In some embodiments, the two straight rods are denoted as:

a second back swing arm, wherein an upper end of the second back swing arm is defined as the second protruding end, and a lower end of the second back swing arm is defined as the top end; and a second micro-motion lever frame, wherein a front end of the second micro-motion lever frame is defined as the first protruding end, and a back end of the second micro-motion lever frame is hinged between the upper end of the second back swing arm and the lower end of the second back swing arm.

In some embodiments, the backstreet connecting rod mechanism further includes a V-shaped connecting structure, the V-shaped connecting structure includes:

a lower swing arm, wherein the lower swing arm is hinged to the frame; and a second transition straight rod, wherein a lower end of the second transition straight rod is hinged to the lower swing arm, and an upper end of the second transition straight rod is hinged to the seat cushion;

the lower end of the second back swing arm is hinged between the upper end of the second transition straight rod and the lower end of the second transition straight rod.

With this arrangement, the V-shaped connecting structure is connected to the second back swing arm to input power for a rotation of the front swing arm and a rotation of the second micro-motion lever frame, thus realizing a synchronous extension and a deformation of the polygonal planar structure following a motion of the seat cushion.

In some embodiments, the second back swing arm and the second transition straight rod are hinged at a second transition hinge point; and the second transition hinge point, a hinge point of the upper end of the second transition straight rod, a hinge point of the upper end of the second back swing arm and a hinge point of the back end of the second micro-motion lever frame are connected in sequence to form a quadrilateral parallel to the polygonal planar structure.

In some embodiments, the second back swing arm and the second micro-motion lever frame are hinged at a second middle hinge point:

a distance between the second transition hinge point and the hinge point at the upper end of the second transition straight rod is defined as Q3, and a distance between the second transition hinge point and the hinge point at the lower end of the second transition straight rod is defined as Q4, and the distance Q3 between the second transition hinge point and the hinge point at the upper end of the second transition straight rod and the distance Q4 between the second transition hinge point and the hinge point at the lower end of the second transition straight rod satisfy following formula: Q3<Q4.

In some embodiments, a distance between the second middle hinge point and the hinge point at the upper end of the second back swing arm is defined as S3, a distance between the second middle hinge point and the hinge point at the lower end of the second back swing arm is defined as S4, and the distance S3 between the second middle hinge point and the hinge point at the upper end of the second back swing arm and the distance S4 between the second middle hinge point and the hinge point at the lower end of the second back swing arm satisfy following formula: S3>S4.

In some embodiments, a length of a connecting line between the hinge point at the front end of the second micro-motion lever frame and the hinge point at the back end of the second micro-motion lever frame is defined as R4, a length of a connecting between the hinge point at the upper end of the second transition straight rod and the second transition hinge point is defined as R5, a length of a connecting between the second transition hinge point and the second middle hinge point is defined as R6, and the length R4 of the connecting line between the hinge point at the front end of the second micro-motion lever frame and the hinge point at the back end of the second micro-motion lever frame, the length R5 of the connecting between the hinge point at the upper end of the second transition straight rod and the second transition hinge point, and the length R6 of the connecting between the second transition hinge point and the second middle hinge point satisfy following formula: R4>R5, and R4>R6.

In some embodiments, the seat frame further includes a telescopic connecting rod mechanism and a spring, and the telescopic connecting rod mechanism includes:

- a first rocking rod, wherein an upper end of the first rocking rod is hinged to the seat cushion;
- a second rocking rod, an upper end of which is hinged to the seat cushion;
- a sliding connecting rod, wherein a lower end of the first rocking rod and a lower end of the second rocking rod are hinged to the sliding connecting rod;
- a first swing rod, wherein a lower end of the first swing rod is hinged to the frame;
- a second swing rod, wherein a lower end of the second swing rod is hinged to the frame;
- a third transmission rod, wherein an upper end of the first swing rod and an upper end of the second swing rod are hinged to the third transmission rod;
- a first transmission rod, wherein an upper end of the first transmission rod is hinged between the upper end of the first swing rod and the lower end of the first swing rod;
- a second transmission rod, wherein an upper end of the second transmission rod is hinged between the upper end of the second swing rod and the lower end of the second swing rod;
- a fourth transmission rod, wherein a front end of the fourth transmission rod is hinged to the first swing rod, and a back end of the fourth transmission rod is hinged between the upper end of the second transmission rod and a lower end of the second transmission rod;
- a first auxiliary rod, wherein the first auxiliary rod is hinged between the upper end of the first transmission rod and a lower end of the first transmission rod, and hinged at the lower end of the second transmission rod;
- a second auxiliary rod, wherein an upper end of the second auxiliary rod is hinged to the first auxiliary rod, and a lower end of the second auxiliary rod is hinged to the sliding connecting rod;
- a third auxiliary rod, wherein an upper end of the third auxiliary rod is hinged to the first auxiliary rod, and a lower end of the third auxiliary rod is hinged to the sliding connecting rod;
- a fourth auxiliary rod, wherein a front end of the fourth auxiliary rod is hinged to the lower end of the first transmission rod, and a back end of the fourth auxiliary rod is hinged between the upper end of the third auxiliary rod and the lower end of the third auxiliary rod; and
- two ends of the spring are connected to the V-shaped connecting structure and the sliding connecting rod respectively.

The present disclosure further provides a seat with switchable sitting and lying positions, and the seat with switchable sitting and lying positions including the above seat frame is provided.

Details of one or more embodiments of this application are presented in the attached drawings and descriptions below. And other features, purposes and advantages of this application will become apparent from the description, drawings and claims.

BRIEF DESCRIPTION OF THE DRAWINGS

For a better description and illustration of embodiments and/or examples of those disclosures disclosed herein, reference may be made to one or more attached drawings. Additional details or examples used to describe the drawings should not be considered as limiting the scope of any of the disclosed disclosures, currently described embodiments and/or examples, and currently understood best modes of these disclosures.

Reference signs are as follows:

100 represents a seat frame; 10 represents a frame; 20 represents a seat cushion; 21 represents a hip and leg support portion; 22 represents a backrest mounting portion; 30 represents a polygonal planar structure; 31 represents a front swing arm; 32 represents a T-shaped connecting rod; 321 represents a first micro-motion lever frame; 322 represents a second micro-motion lever frame; 323 represents a first back swing arm; 324 represents a second back swing arm; 325 represents a first protruding end; 326 represents a second protruding end; 327 represents a top end; 33 represents a back pole frame; 331 represents a body portion; 332 represents a backrest support portion; 40 represents a V-shaped connecting structure; 41 represents a lower swing arm; 421 represents a first transition straight rod; 422 represents a second transition straight rod; 50 represents a telescopic connecting rod mechanism; 51 represents a first rocking rod; 52 represents a second rocking rod; 53 represents a sliding connecting rod; 54 represents a first swing rod; 55 represents a second swing rod; 56 represents a first transmission rod; 57 represents a second transmission rod; 58 represents a third transmission rod; 59 represents a fourth transmission rod; 60 represents a drive; 61 represents a first auxiliary rod; 62 represents a second auxiliary rod; 63 represents a third auxiliary rod; 64 represents a fourth auxiliary rod; 70 represents a spring; and 80 represents a footrest.

DETAILED DESCRIPTION

To make the above-mentioned objects, features and advantages of the present disclosure more apparent and easier to understand, and the specific embodiments of the present disclosure are described in detail below with reference to the accompanying drawings. Numerous specific details are set forth in the following description to facilitate a sufficient understanding of the present disclosure. However, the present disclosure can be implemented in many other ways different from that described herein, and a person skilled in the art may perform similar improvements without departing from the connotation of the present disclosure, and therefore, the present disclosure is not limited by the specific embodiments disclosed below.

Unless otherwise defined, all technical and scientific terms used herein have the same meaning as commonly understood by those skilled in the technical field of this application. The terminology used herein in the specification of this application is only for the purpose of describing specific embodiments, and is not intended to limit this application. As used herein, the term "or/and" includes any and all combinations of one or more related listed items.

Figure 1:
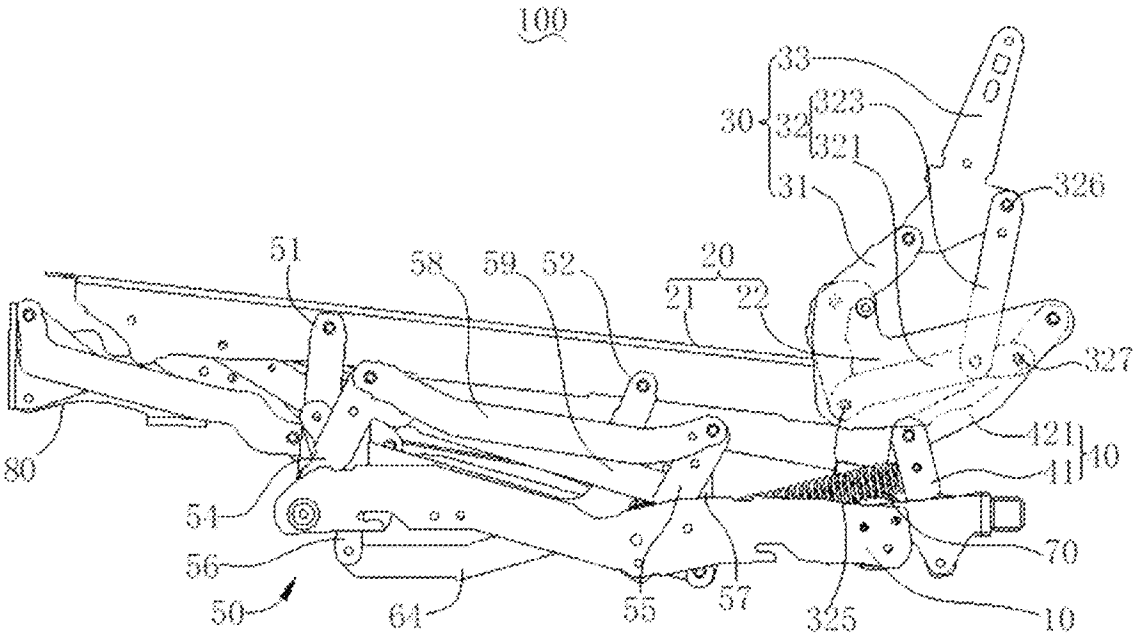
FIG. 1 is a schematic side view of a seat frame in a sitting position according to an embodiment of the present disclosure.
Figure 2:
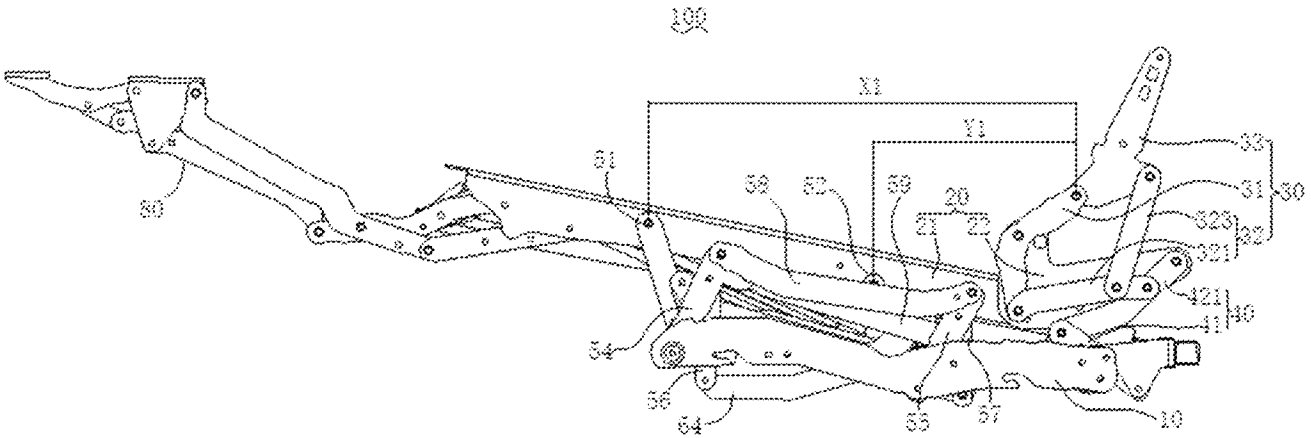
FIG. 2 is a schematic side view of a seat frame in a leisure position according to an embodiment of the present disclosure.
Figure 3:
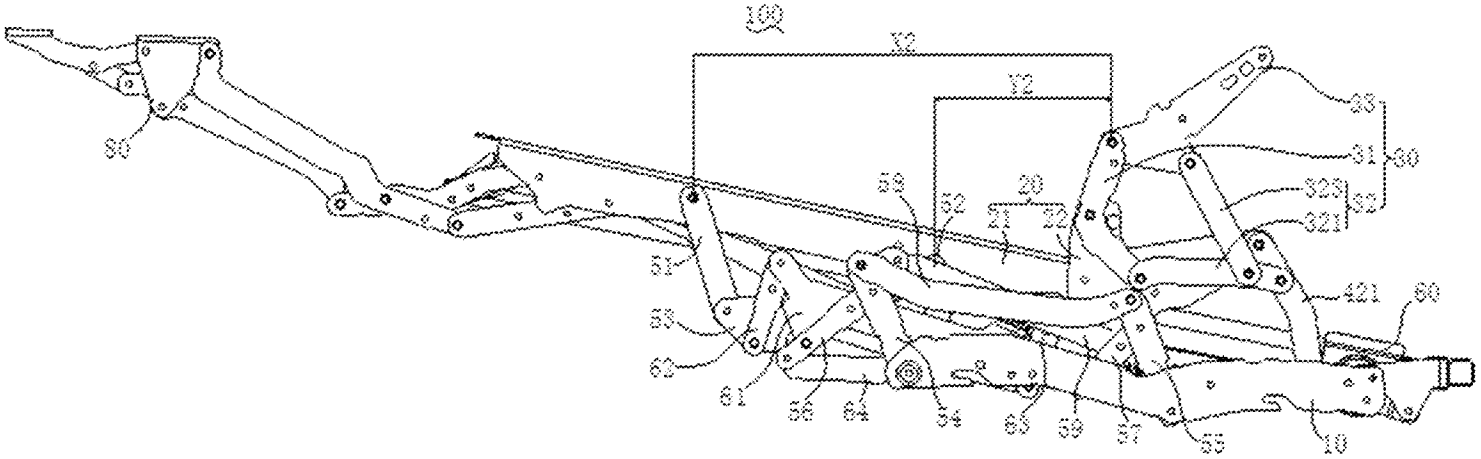
FIG. 3 is a schematic side view of a seat frame in a lying position according to an embodiment of the present disclosure.

Referring to FIG. 1 to FIG. 3, the present disclosure provides a seat frame 100 and a seat with switchable sitting and lying positions with the seat frame 100, and the seat with switchable sitting and lying positions is obtained after the seat frame 100 is coated with a filler and a skin member. The seat frame 100 provided by the present disclosure has three states, namely, a sitting position shown in FIG. 1, FIG. 5, FIG. 8 and FIG. 10, a leisure position shown in FIG. 2 and FIG. 6, and a lying position shown in FIG. 3, FIG. 7, FIG. 11 and FIG. 12.

Referring to FIG. 1 to FIG. 7, in an embodiment, the seat frame 100 includes a frame 10, a telescopic connecting rod mechanism 50 movably connected to the frame 10, a seat cushion 20 suspended above the frame 10 and movably connected to the frame 10 by connecting the telescopic connecting rod mechanism 50, a footrest 80 movably connected to a front end of the seat cushion 20, a backrest connecting rod mechanism movably connected to a back end of the seat cushion 20 and a back end of the frame 10, a spring 70 connected to the backrest connecting rod mechanism and the telescopic connecting rod mechanism 50 and a driving member 60 installed at the back end of the frame 10 and drivably connected to the footrest 80.

It should be added here that the front end and the back end expressions in the present disclosure are all based on the seat frame 100 shown in FIG. 1 to FIG. 4, FIG. 8, FIG. 9 and FIG. 11. The front end of a component represents an end at a left side of the component in the above figure, and the back end of a component represents an end at a right side of the component in the above figure. Similarly, the upper end of a component represents an end at an upper side of the component in the above figure, that is, the end farther from ground, and the lower end of a component represents an end at a lower side of the component in the above figure, that is, the end adjacent to the ground.

Referring to FIG. 1, a front end and a back end of the seat cushion 20 are a left end and a right end of the seat cushion 20 as shown in the figure, respectively. When the seat frame 100 is placed on the ground, the frame 10 and the ground are relatively static, and the seat cushion 20 is arranged above the frame 10. The seat cushion 20 is used to carry human, which is a main load-bearing device in the seat frame 100. The footrest 80 is used to support human legs and feet, and the backrest connecting rod mechanism is used to support human back. When the user sits on the seat frame 100, a face of the user is toward to the left in the figure.

Referring to FIG. 1, FIG. 5, FIG. 8 and FIG. 10, when the seat frame 100 is in the sitting position, the footrest 80, the telescopic connecting rod mechanism 50 and the backrest connecting rod mechanism are all in a contracted state. Specifically, the footrest 80 is contracted under the front end of the seat cushion 20, the telescopic connecting rod mechanism 50 is contracted in a vertically lower area of the seat cushion 20, and the back connecting rod mechanism is contracted in an upper area of the back end of the seat cushion 20.

Figure 5:
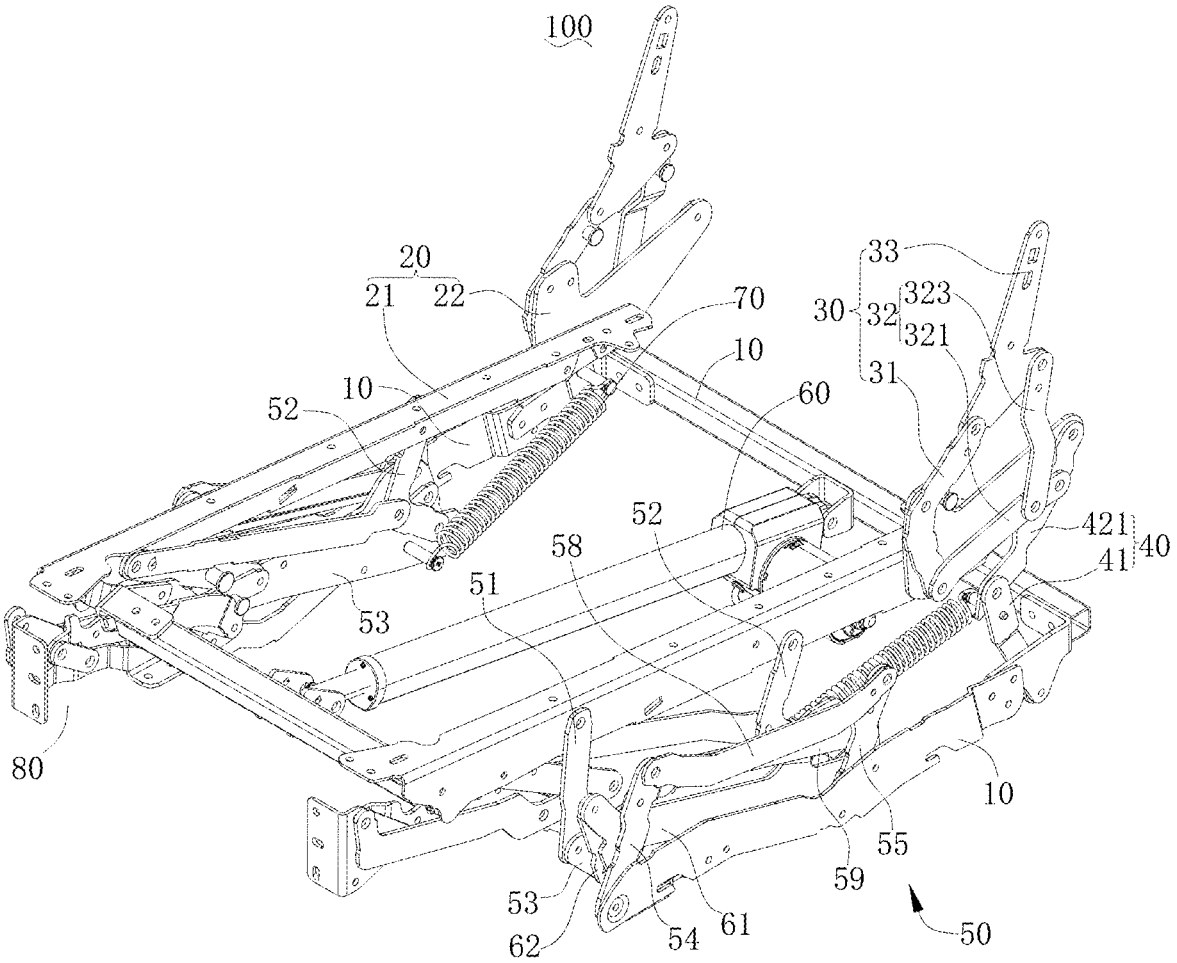
FIG. 5 is a perspective view of a seat frame in a sitting position according to an embodiment of the present disclosure.
Figure 10:
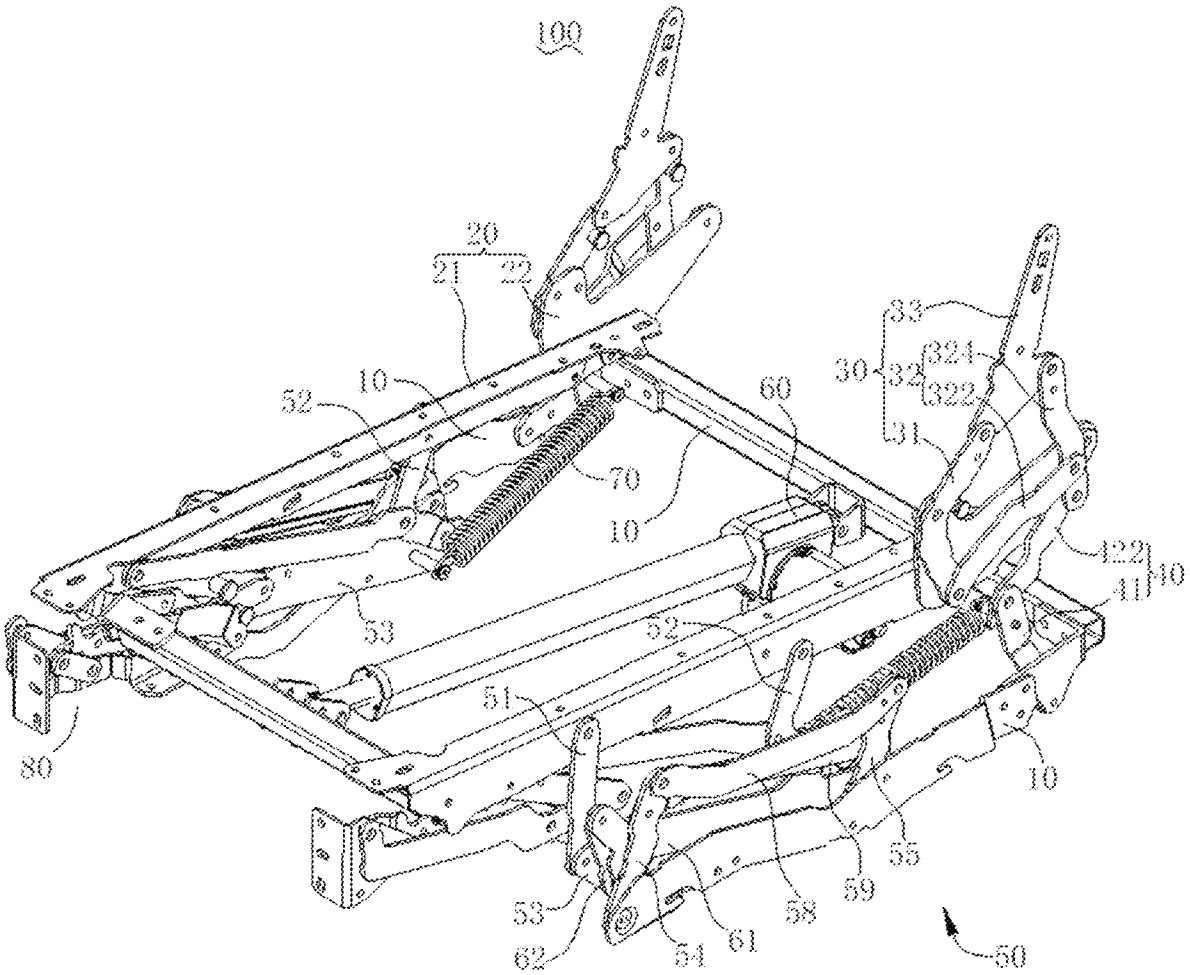
FIG. 10 is a perspective view of a seat frame in a sitting position according to another embodiment of the present disclosure.

Optionally, the driving member 60 is a push rod motor with a telescopic rod, a body of the push rod motor is hinged to the frame 10, and the telescopic rod of the push rod motor extends out of the body of the push rod motor and is hinged to the footrest 80. Referring to FIG. 5 and FIG. 10, when the seat frame 100 is in the sitting position, the driving member 60 is in a contracted state, and a length of the telescopic rod extending out of the body of the push rod motor is minimum.

Figure 6:
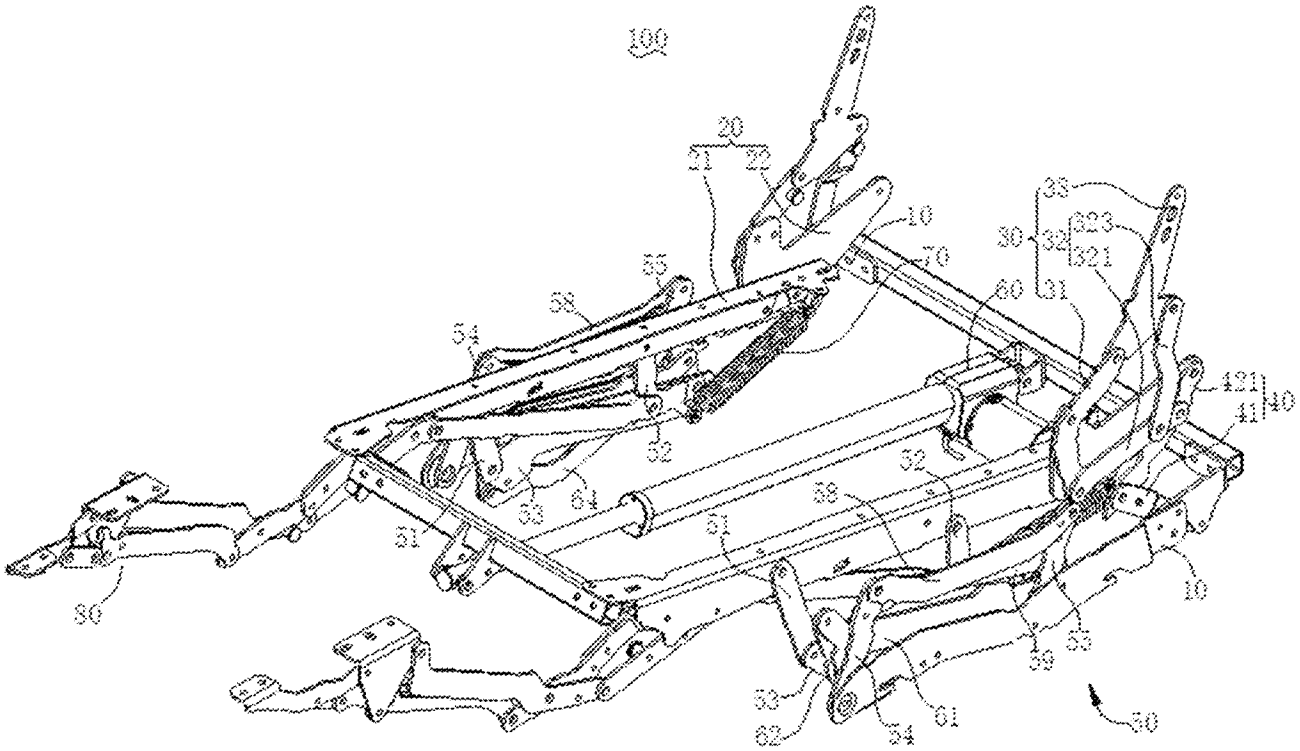
FIG. 6 is a perspective view of a seat frame in a leisure position according to an embodiment of the present disclosure.

When the seat frame 100 is in the leisure position, the footrest 80 is in an extended state extending forward relative to the front end of the seat cushion 20, and the telescopic connecting rod mechanism 50 is slightly extended compared with the lying position. The backrest mechanism is still basically maintained in the contracted state as in the lying position, and the seat cushion 20 moves forward slightly relative to the frame 10 for a certain distance, and the forward movement of the seat cushion 20 enables the seat frame 100 to adapt to a change of a center of gravity position after the human leg is lifted by the footrest 80. Referring to FIG. 6, when the seat frame 100 is in the leisure position, the length of the telescopic rod extending out of the pusher motor body is increased compared with that in the lying position, so the driving member 60 is extended within a certain range to drive the seat cushion 20 to move forward a little distance relative to the frame 10.

Figure 7:
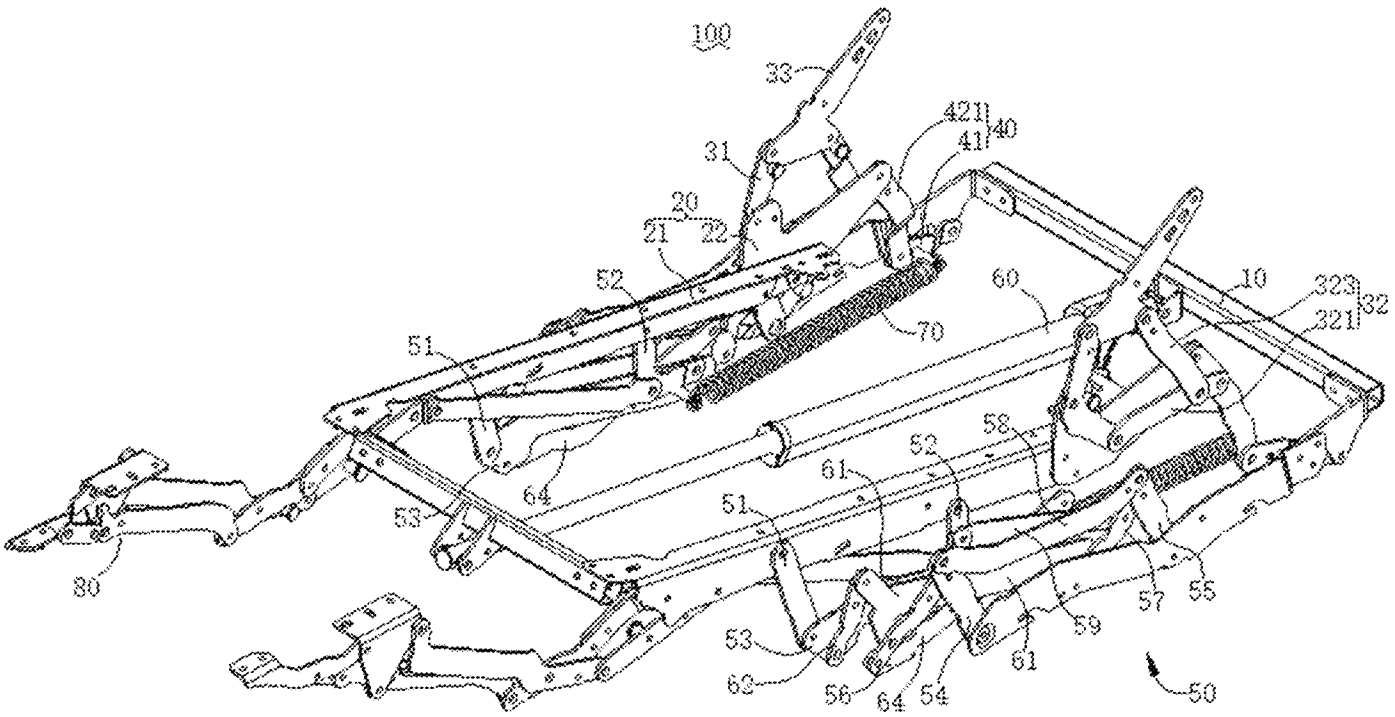
FIG. 7 is a perspective view of a seat frame in a lying position according to an embodiment of the present disclosure.
Figure 12:
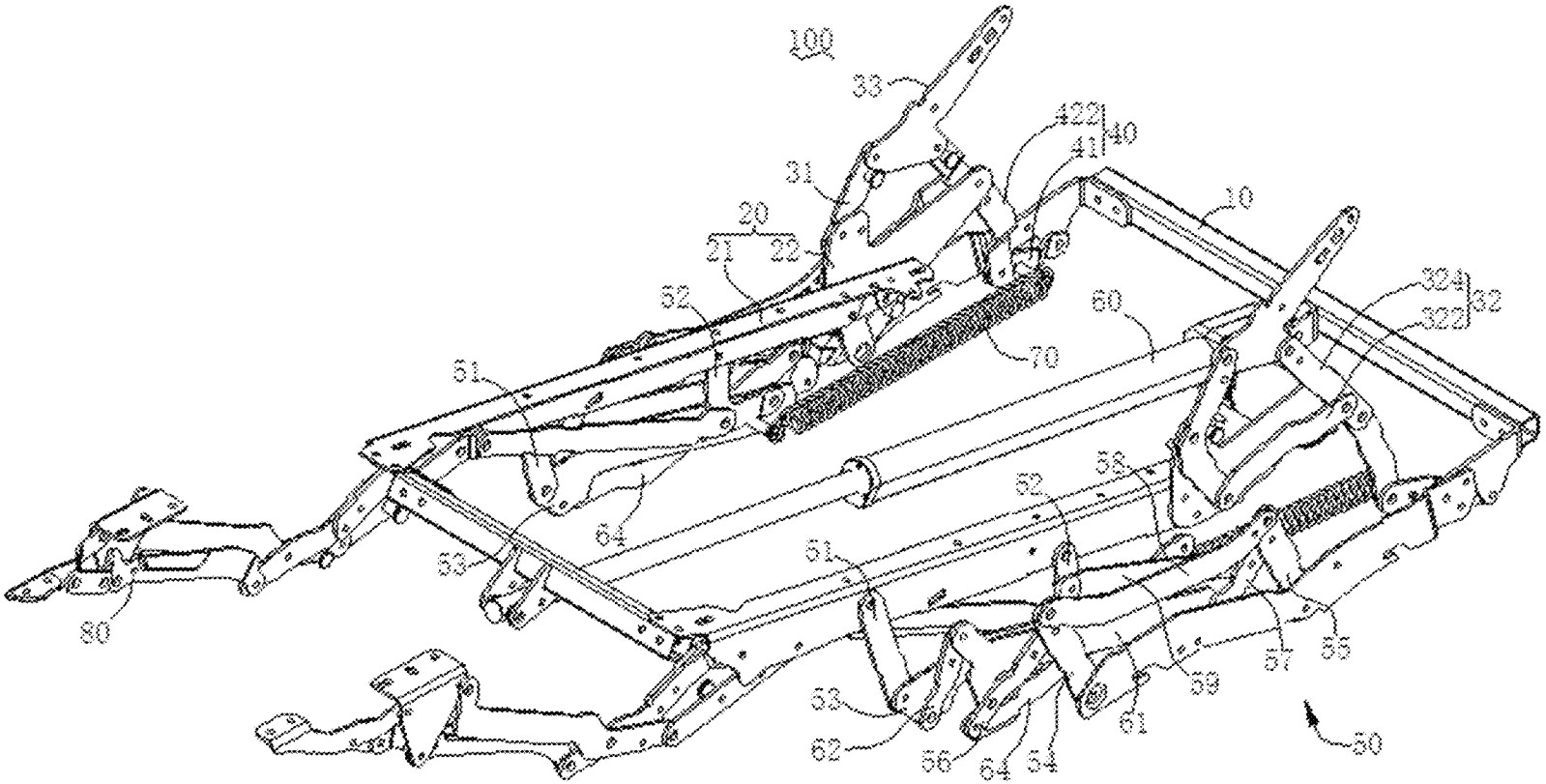
FIG. 12 is a perspective view of a seat frame in a lying position according to another embodiment of the present disclosure.
Figure 13:
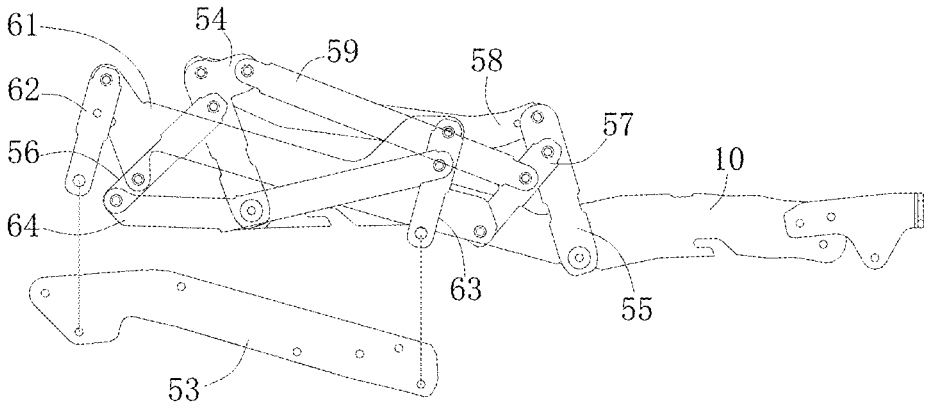
FIG. 13 is a partial structural diagram of a seat frame according to an embodiment of the present disclosure.
Figure 14:
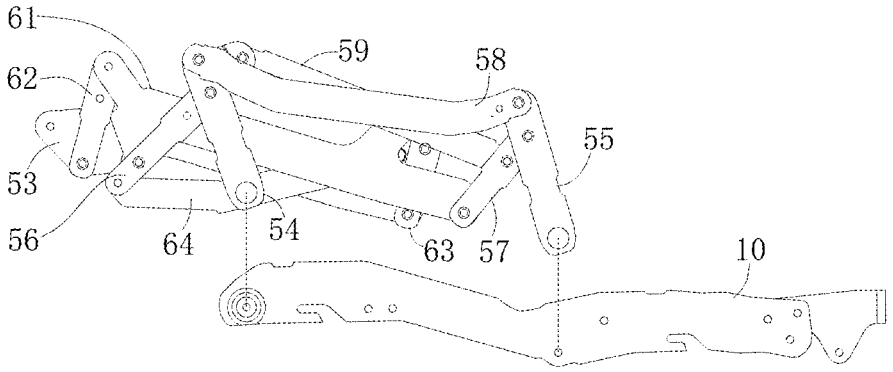
FIG. 14 is a partial structural diagram of a seat frame according to an embodiment of the present disclosure.

When the seat frame 100 is in the lying position, the footrest 80 continues to extend out of the front end of the seat cushion 20, and the telescopic connecting rod mechanism 50 and the backrest mechanism are further extended compared with the leisure position. So as to be in a fully extended state, the seat cushion 20 moves forward for a certain distance compared with that in the leisure position, so that the seat frame 100 can adapt to the change of the position of the center of gravity of the user after lying on the backrest, and the backrest connecting rod mechanism moves forward for a certain distance greatly relative to the frame 10, and rotates backward greatly relative to the frame 10. Referring to FIG. 7 and FIG. 12, a length of the telescopic rod extending out of the putter motor body is increased compared with that in the leisure position, so the driving member 60 is further extended on a basis of that in the leisure position, further driving the seat cushion 20 to move forward, and further driving the telescopic connecting rod mechanism 50 to stretch and deform.

Specifically, the seat cushion 20 includes a hip and leg support portion 21, a backrest mounting portion 22 fixedly connected to a back end of the hip and leg support portion 21, the footrest 80 can be movably installed at a front end of the hip and leg support portion 21, that is the end of the hip and leg support portion 21 away from the backrest mounting portion 22. An included angle between the back pole frame 33 and the hip and leg support portion 21 hardly changes during an extension of the telescopic pole from a state shown in FIG. 1 to a state shown in FIG. 2 and from a state shown in FIG. 5 to a state shown in FIG. 6. The included angle between the back pole frame 33 and the hip and leg support portion 21 increases significantly during an extension of the telescopic pole from the state shown in FIG. 2 to the state shown in FIG. 3 and from a state shown in FIG. 6 to a state shown in FIG. 7.

Referring to FIG. 1, FIG. 3, FIG. 7, FIG. 12, FIG. 13 and FIG. 14, the telescopic connecting rod mechanism 50 includes a first rocking rod 51 hinged at the front end of the hip and leg support portion 21, a second rocking rod 52 hinged between the front end of the hip and leg support portion 21 and the back end of the hip and leg support portion 21, a sliding connecting rod 53 hinged to the first rocking rod 51 and the second rocking rod 52, a first swing rod 54 hinged to the frame 10, and a second swing rod 55 hinged to the frame 10.

Furthermore, the telescopic connecting rod mechanism 50 further includes a first transmission rod 56 hinged to the first swing rod 54, a second transmission rod 57 hinged to the second swing rod 55, a third transmission rod 58 hinged to the first swing rod 54 and a second swing rod 55, and a fourth transmission rod 59 hinged to the first swing rod 54 and the second transmission rod 57.

Furthermore, the telescopic connecting rod mechanism 50 further includes a first auxiliary rod 61 hinged to the first transmission rod 56 and the second transmission rod 57, a second auxiliary rod 62 hinged to the first auxiliary rod 61 and the sliding connecting rod 53, a third auxiliary rod 63 hinged to the first auxiliary rod 61 and the sliding connecting rod 53, and a fourth auxiliary rod 64 hinged to the first transmission rod 56 and the third auxiliary rod 63.

In an embodiment, under a condition that the seat frame 100 is fixedly placed on the ground, each bar in the telescopic connecting rod mechanism 50 moves in a vertical plane.

Specifically, an upper end of the first rocking rod 51 and a lower end of the first rocking rod 51 are hinged to the hip and leg support portion 21 and the sliding connecting rod 53, respectively. An upper end of the second rocking rod 52 and a lower end of the second rocking rod 52 are hinged to the hip and leg support portion 21 and the sliding connecting rod 53, respectively. An upper end of the first swing rod 54 and a lower end of the first swing rod 54 are hinged to a front end of the third transmission rod 58 and the frame 10, respectively, and an upper end of the second swing rod 55 and a lower end of the second swing rod 55 are hinged to a back end of the third transmission rod 58 and the frame 10, respectively.

An upper end of the first transmission rod 56 is hinged between the upper end of the first swing rod 54 and the lower end of the first swing rod 54, and a lower end of the first transmission rod 56 is hinged to a front end of the fourth auxiliary rod 64. An upper end of the second transmission rod 57 is hinged between the upper end of the second swing rod 55 and the lower end of the first swing rod 54, and a lower end of the second transmission rod 57 is hinged to a back end of the first auxiliary rod 61. A front end of the fourth transmission rod 59 is hinged to the first swing rod 54, and a back end of the fourth transmission rod 59 is hinged to a part of the second transmission rod 57 between the upper end of the second transmission rod 57 and the lower end of the second transmission rod 57.

A first auxiliary rod 61 is hinged between the upper end of the first transmission rod 56 and the lower end of the first transmission rod 56. An upper end of the second auxiliary rod 62 and a lower end of the second auxiliary rod 62 are hinged to the front end of the first auxiliary rod 61 and the sliding connecting rod 53, respectively. An upper end of the third auxiliary rod 63 and a lower end of the third auxiliary rod 63 are hinged to the first auxiliary rod 61 and the sliding connecting rod 53, respectively. A front end of the fourth auxiliary rod 64 is hinged to the lower end of the first transmission rod 56, and a back end of the fourth auxiliary rod 64 is hinged to a part of the third auxiliary rod 63 between the upper end of the third auxiliary rod 63 and the lower end of the third auxiliary rod 63.

When switching from the sitting position to the leisure position, the main changes of the telescopic connecting rod mechanism 50 include: the first rocking rod 51 and the second rocking rod 52 rotate relative to the frame 10 to adapt to a forward movement of the seat cushion 20 relative to the frame 10.

When switching from the leisure position to the lying position, the main changes of the telescopic connecting rod mechanism 50 include: the sliding connecting rod 53, the first rocking rod 51 and the second rocking rod 52 move forward, the first swing rod 54 and the second swing rod 55 rotate relative to the frame 10 and drive the third transmission rod 58 to move forward relative to the frame 10. The first transmission rod 56 and the second transmission rod 57 move forward relative to the frame 10 and rotate respectively.

In a process of switching from the sitting position to the leisure position, the first auxiliary rod 61, the second auxiliary rod 62, the third auxiliary rod 63 and the fourth auxiliary rod 64 basically do not exercise or only slightly exercise. In a process of switching from the leisure position to the lying position, the second auxiliary rod 62 and the third auxiliary rod 63 move forward with the sliding connecting rod 53, and at the same time, the fourth auxiliary rod 64 and the first auxiliary rod 61 are driven forward.

The backrest connecting rod mechanism includes a polygonal planar structure 30 and a V-shaped connecting structure 40. The polygonal planar structure 30 includes a front swing arm 31, a back pole frame 33 and a T-shaped connecting rod 32, and the T-shaped connecting rod 32 includes two straight rods hinged with each other. The two straight bars can rotate relatively to change an included angle between the two straight bars. The included angle between the two straight bars enables the T-shaped connecting rod to change between a positive T-shape and an oblique T-shape. When the T-shaped connecting rod 32 is the positive T-shape, the two straight bars are perpendicular to each other. When the T-shaped connecting rod is the oblique T-shape, the two straight bars are not perpendicular.

The seat cushion 20 is hinged between an upper end of the front swing arm 31 and a lower end of the front swing arm 31, and a front end of the back pole frame 33 is hinged to the upper end of the front swing arm 31. In the T-shaped connecting rod, an end of one of the two straight rods forms a first protruding end 325, which is hinged to the lower end of the front swing arm 31, a second protruding end 326 is formed at an end of the other of the two straight rods, which is hinged to the back end of the back pole frame 33, and one of the two straight bars forms the top end 327, which is movably connected to the frame 10.

Furthermore, in the embodiment shown in FIG. 1 to FIG. 7, the two straight rods in the T-shaped connecting rod 32 are a first micro-motion lever frame 321 and a first back swing arm 323, respectively. The V-shaped connecting structure 40 includes a lower swing arm 41 and a first transition straight rod 421 hinged to the frame 10.

Specifically, the front end of the backrest mounting portion 22 is hinged to the front swing arm 31, and a hinge point of the backrest mounting portion 22 being hinged in the front swing arm 31 is located between the upper end and the lower end of the front swing arm 31.

A front end of the first micro-motion lever frame 321 is defined as the first protruding end 325 hinged to the lower end of the front swing arm 31. That is, an end of the first micro-motion lever frame 321 adjacent to the footrest 80 is hinged to the end of the front swing arm 31 adjacent to the frame 10.

The top end 327 hinged to the first transition straight rod 421 is formed at a back end of the first micro-motion lever frame 321. That is, an end of the first micro-motion lever frame 321 away from the footrest 80 is hinged to the first transition straight rod 421.

A front end of the back pole frame 33 is hinged to the upper end of the front swing arm 31, that is, an end of the back pole frame 33 adjacent to the footrest 80 is hinged to the end of the front swing arm 31 away from the frame 10.

An upper end of the first back swing arm 323 is defined as the second protruding end 326 hinged to a back end of the back pole frame 33, that is, an end of the first back swing arm 323 away from the frame 10 is hinged to the end of the back pole frame 33 away from the footrest 80.

A lower end of the first back swing arm 323 is hinged to a part of the first micro-motion lever frame 321 between a front end of the first micro-motion lever frame 321 and a back end of the first micro-motion lever frame 321, that is, an end of the first back swing arm 323 adjacent to the frame 10 is hinged between the front end of the first micro-motion lever frame 321 and the back end of the first micro-motion lever frame 321.

The lower swing arm 41 is hinged to a back end of the frame 10, and the first transition straight rod 421 is hinged to the lower swing arm 41 at one end adjacent to the ground. An end of the first transition straight rod 421 away from the ground is hinged to the backrest mounting portion 22, that is, a lower end of the first transition straight rod 421 and an upper end of the first transition straight rod 421 are hinged to the lower swing arm 41 and the seat cushion 20, respectively.

The back pole frame 33 formed by the front swing arm 31, the first back swing arm 323, the first micro-motion lever frame 321, and the polygonal planar structure 30 is a planar linkage mechanism, and in the V-shaped connecting structure 40, a V-shaped included angle with variable opening size is formed between the first transition straight rod 421 and the lower swing arm 41, and both the first transition straight rod 421 and the lower swing arm 41 move in a vertical plane parallel to the polygonal planar structure 30.

Driven by the driving member 60, the seat cushion 20 can move relative to the frame 10 in a vertical plane parallel to the polygonal planar structure 30 according to a predetermined trajectory.

Figure 4:
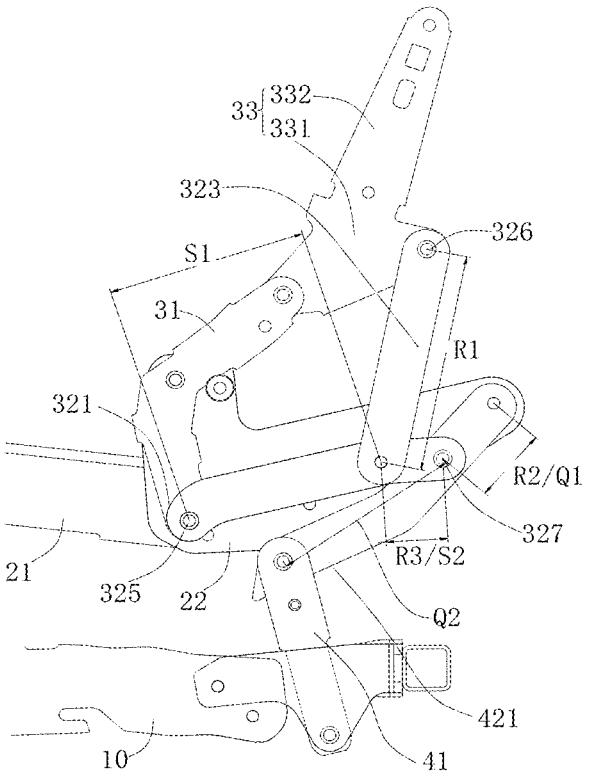
FIG. 4 is a partial schematic view of a seat frame in a sitting position according to an embodiment of the present disclosure.

Referring to FIG. 4, the back pole frame 33 includes a body portion 331 and a back rest support portion 332 protruding from the body portion 331. Two ends of the body portion 331 form the front end of the back pole frame 33 and the back end of the back pole frame 33, respectively. And the backrest support portion 332 extends outward in a direction away from the frame 10 and the ground when the seat frame 100 is in a sitting position and a leisure position, as shown in FIG. 1, FIG. 2, FIG. 5 and FIG. 10.

Figure 11:
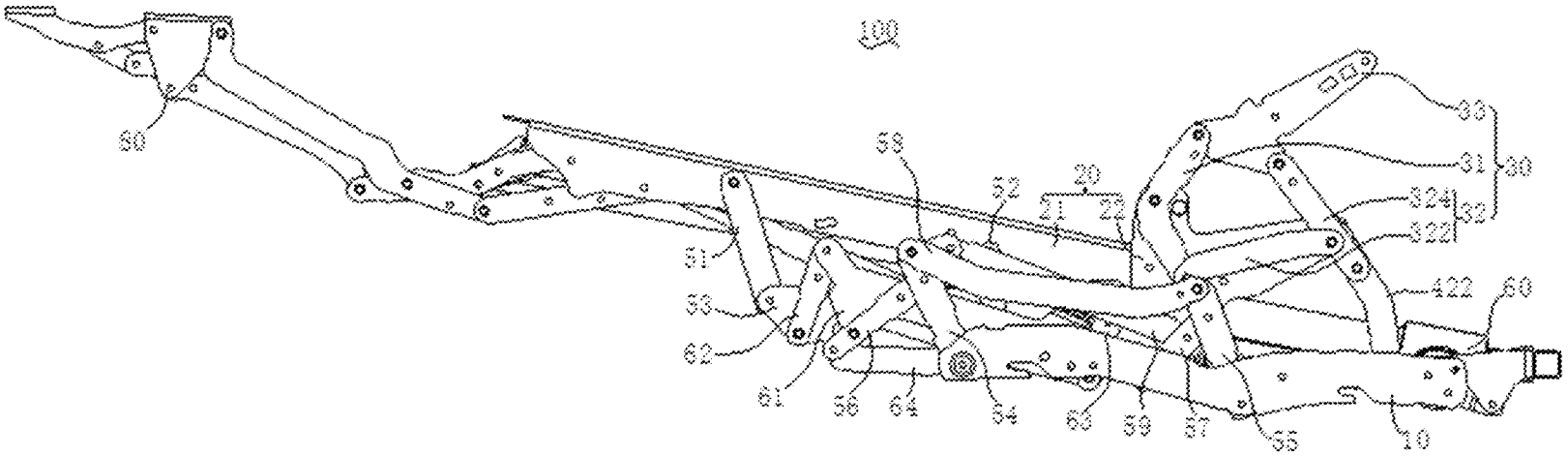
FIG. 11 is a schematic side view of a seat frame in a lying position according to another embodiment of the present disclosure.

When the seat frame 100 is switched to the lying position, the back rest support port 332 rotates backward, and an included angle between the back rest support port 332 and the hip and leg support portion 21 is significantly increased compared with the sitting position and the leisure position, as shown in FIG. 3 and FIG. 11. It should be noted that the included angle between the back pole frame 33 and the seat cushion 20 is the included angle between the backrest support portion 332 and the hip and leg support portion 21.

In an embodiment, referring to FIG. 4, a middle hinge point for hinge with the backrest mounting portion 22 is provided between the upper end of the front swing arm 31 and the lower end of the front swing arm 31. The middle hinge point serves as a pivot point of the front swing arm 31, and the hinge point of the front swing arm 31 hinged to the first micro-motion lever frame 321 is the hinge point of the lower end of the front swing arm 31. The hinge point of the front swing arm 31 hinged to the back pole frame 33 is the hinge point of the upper end of the front swing arm 31. When the seat frame 100 switches from the leisure position to the lying position, the first micro-motion lever frame 321 only needs to drive the hinge point at the lower end of the front swing arm 31 to rotate slightly, and the hinge point at the upper end of the front swing arm 31 can generate a long-stroke arc motion. The arc motion enables the back pole frame 33 to move forward greatly relative to the frame 10.

One end of the spring 70 is connected to the sliding connecting rod 53, and the other end of the spring 70 is connected to the V-shaped connecting structure 40. Referring to FIG. 5 to FIG. 7 and FIG. 12, in some embodiments, the end of the spring 70 away from the sliding connecting rod 53 is connected to the lower swing arm 41. The spring 70 is always in tension state, so the spring 70 has elastic potential energy of contraction and deformation, which tends to drive the sliding connecting rod 53 to move backward relative to the frame 10. Therefore, an elastic potential energy of the spring 70 has a tendency to drive the telescopic connecting rod mechanism 50 to contract, thereby switching the seat frame 100 from the lying position to the leisure position or the sitting position.

When the user wants to switch the seat frame 100 from the lying position to the leisure position or to the sitting position, the telescopic rod of the driving member 60 is gradually retracted into the main body of push rod motor, and at the same time, the spring 70 is gradually compressed, and drives the footrest 80 to retract, and further drives the telescopic connecting rod mechanism 50 and the back connecting rod mechanism to retract. Finally, the included angle between the back pole frame 33 and the seat cushion 20 is reduced. It can be seen that the spring 70 can promote the switch of the seat frame from the lying position to the leisure position or the sitting position.

Referring to FIG. 4, the first micro-motion lever frame 321 and the first transition straight rod 421 are hinged at a first transition hinge point, the first transition hinge point is the hinge point at the top end 327. The first transition hinge point, the hinge point of the lower end of the first back swing arm 323, the hinge point of the upper end of the first back swing arm 323. And the hinge point of the upper end of the first transition straight rod 421 is connected to form a quadrilateral, which is parallel to a quadrilateral where the polygonal planar structure 30 is located.

The hinge point of the lower end of the first back swing arm 323 is the hinge point between the first back swing arm 323 and the first micro-motion lever frame 321. The hinge point of the upper end of the first back swing arm 323 is the hinge point between the first back swing arm 323 and the back pole frame 33. The hinge point of the upper end of the first transition straight rod 421 is the hinge point between the first transition straight rod 421 and the backrest mounting portion 22. The hinge point of the lower end of the first transition straight rod 421 is the hinge point between the first transition straight rod 421 and the lower swing arm 41.

In an embodiment, the lower end of the first back swing arm 323 and the first micro-motion lever frame 321 are hinged at a first middle hinge point, a distance between the first middle hinge point and the hinge point at the front end of the first micro-motion lever frame 321 is defined as S1, and a distance between the first middle hinge point and the hinge point at the back end of the first micro-motion lever frame 321 is defined as S2, the distance S1 between the first middle hinge point and the hinge point at the front end of the first micro-motion lever frame 321 and the distance S2 between the first middle hinge point and the hinge point at the back end of the first micro-motion lever frame 321 satisfy following formula: S1>S2.

In an embodiment, a distance between the first transition hinge point and the hinge point at the upper end of the first transition straight rod 421 is defined as Q1, and a distance between the first transition hinge point and the hinge point at the lower end of the first transition straight rod 421 is defined as Q2, the distance Q1 between the first transition hinge point and the hinge point at the upper end of the first transition straight rod 421 and the distance Q2 between the first transition hinge point and the hinge point at the lower end of the first transition straight rod 421 satisfy following formula: Q1<Q2.

In an embodiment, a length of a connecting line between the hinge point of the upper end of the first back swing arm 323 and the hinge point of the lower end of the first back swing arm 323 is defined as R1, a length of a connecting line between the hinge point at the upper end of the first transition straight rod 421 and the first transition hinge point is defined as R2, and a length of a connecting line between the first transition hinge point and the first middle hinge point is defined as R3, the length R1 of a connecting line between the hinge point of the upper end of the first back swing arm 323 and the hinge point of the lower end of the first back swing arm 323, the length R2 of a connecting line between the hinge point at the upper end of the first transition straight rod 421 and the first transition hinge point, and the length R3 of a connecting line between the first transition hinge point and the first middle hinge point satisfy following formula: R1>R2, and R1>R3.

Referring to FIG. 8 to FIG. 12, another embodiment of the present disclosure provides a seat frame 100. The seat frame 100 in this embodiment (abbreviated as the seat frame of the second embodiment) is substantially the same as that of the seat frame 100 shown in FIG. 1 to FIG. 7 (abbreviated as the seat frame of the first embodiment), the difference is in that: the frame 10 is movably connected with the back swing arm instead of a micro-motion lever frame, and in the seat frame of this embodiment, the back swing arm is hinged with a transition lever frame.

Figure 8:
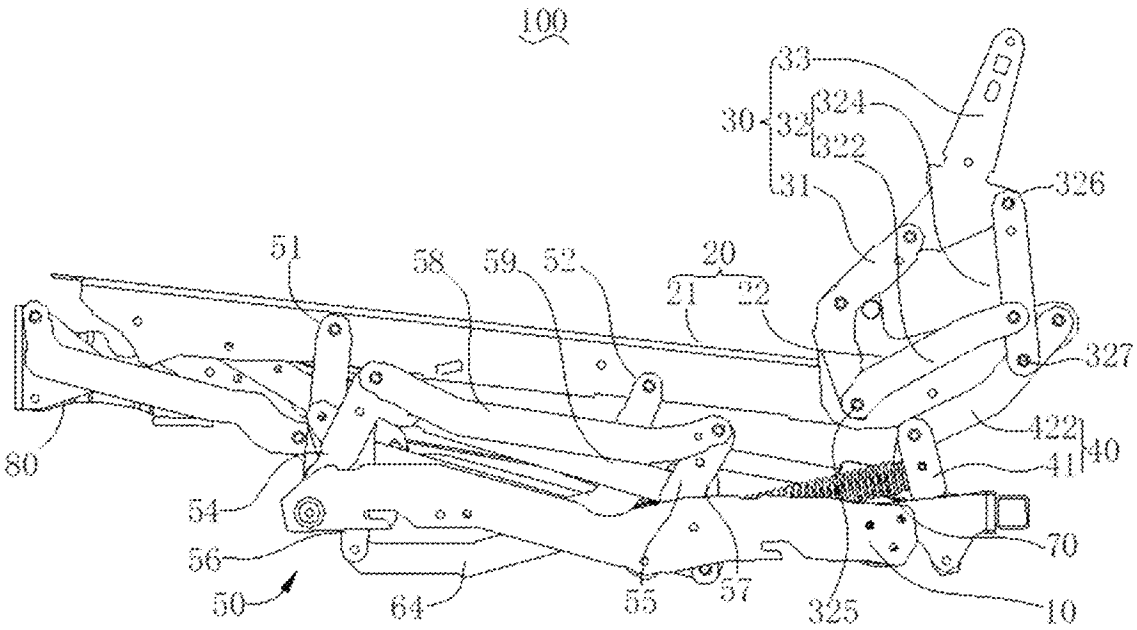
FIG. 8 is a schematic side view of a seat frame in a sitting position according to another embodiment of the present disclosure.
Figure 9:
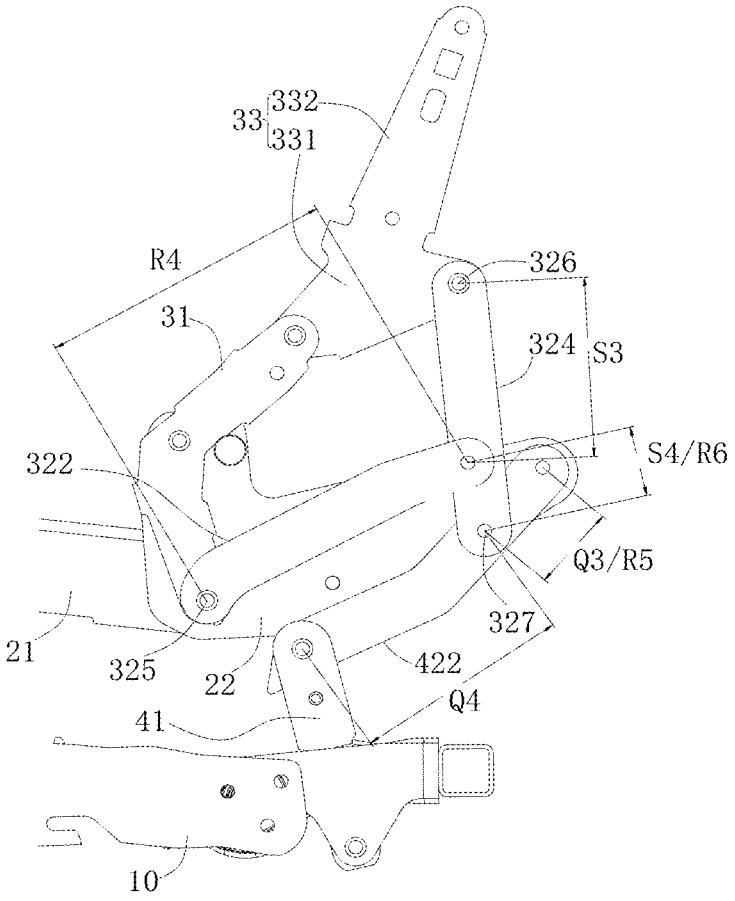
FIG. 9 is a partial schematic view of a seat frame in a sitting position according to another embodiment of the present disclosure.

Referring to FIG. 8 to FIG. 9, in this embodiment, the two straight rods of the T-shaped connecting rod 32 are a second back swing arm 324 and a second micro-motion lever frame 322 which are hinged with each other. An upper end of the second back swing arm 324 forms the second protruding end 326 hinged to the back pole frame 33, a front end of the second micro-motion lever frame 322 forms the first protruding end 325 hinged to the front swing arm 31, and a lower end of the second back swing arm 324 forms the top end 327 hinged to the V-shaped connecting structure 40.

The V-shaped connecting structure 40 includes a lower swing arm 41 hinged to the frame 10 and a second transition straight rod 422. A lower end of the second transition straight rod 422 is hinged to the lower swing arm 41, and an upper end of the second transition straight rod 422 is hinged to the backrest mounting portion 22, thereby realizing an articulation of the second transition straight rod 422 and the seat cushion 20. The lower end of the second back swing arm 324 is hinged to a part of the second transition straight rod 422 between the upper end of the second transition straight rod 422 and the lower end of the second transition straight rod 422.

The front swing arm 31, the second back swing arm 324, the second micro-motion lever frame 322, and the polygonal planar structure 30 for by the back pole frame 33 is a planar linkage mechanism, and in the V-shaped connecting structure 40, a V-shaped included angle with variable opening size is formed between the second transition straight rod 422 and the lower swing arm 41, and both the second transition straight rod 422 and the lower swing arm 41 move in a vertical plane parallel to the polygonal planar structure 30.

Driven by the driving member 60, the seat cushion 20 moves relative to the frame 10 in a vertical plane parallel to the polygonal planar structure 30 according to a predetermined trajectory.

In the seat frame 100 of the second embodiment, the connection mode and structure of the front swing arm 31 and the back pole frame 33 are the same as those of the seat frame 100 of the first embodiment. In the seat frame 100 of the second embodiment, the connection modes and structures of the telescopic connecting rod mechanism 50, the footrest 80, the driving member 60 and the spring 70 are the same as those of the seat frame 100 of the first embodiment, so it will not be repeated here.

In an embodiment, the second back swing arm 324 and the second transition straight rod 422 are hinged at a second transition hinge point. The second transition hinge point is located between the upper end of the second transition straight rod 422 and the lower end of the second transition straight rod 422 and is also the hinge point at the top end 327. The second transition hinge point, the hinge point of the upper end of the second transition straight rod 422, the hinge point of the upper end of the second back swing arm 324, and the second micro-motion lever frame 322 are connected in sequence to form a quadrilateral parallel to the polygonal planar structure 30.

In an embodiment, the second back swing arm 324 and the second micro-motion lever frame 322 are hinged at a second middle hinge point. The second middle hinge point is located between the upper end of the second back swing arm 324 and the lower end of the second back swing arm 324. A distance between the second transition hinge point and the hinge point at the upper end of the second transition straight rod is defined as Q3, and a distance between the second transition hinge point and the hinge point at the lower end of the second transition straight rod is defined as Q4, the distance Q3 between the second transition hinge point and the hinge point at the upper end of the second transition straight rod and the distance Q4 between the second transition hinge point and the hinge point at the lower end of the second transition straight rod satisfy following formula: $Q3<Q4$.

In an embodiment, a distance between the second middle hinge point and the hinge point at the upper end of the second back swing arm 324 is defined as S3, and a distance between the second middle hinge point and the hinge point at the lower end of the second back swing arm 324 is defined as S4, and the distance S3 between the second middle hinge point and the hinge point at the upper end of the second back swing arm 324 and the distance S4 between the second middle hinge point and the hinge point at the lower end of the second back swing arm 324 satisfy following formula: $S3>S4$.

In an embodiment, a length of a connecting line between the hinge point at the front end of the second micro-motion lever frame 322 and the hinge point at the back end of the second micro-motion lever frame 322 is defined as R4, a length of a connecting between the hinge point at the upper end of the second transition straight rod 422 and the second transition hinge point is defined as R5, and a length of a connecting between the second transition hinge point and the second middle hinge point is defined as R6, and the length R4 of the connecting line between the hinge point at the front end of the second micro-motion lever frame 322 and the hinge point at the back end of the second micro-motion lever frame 322, the length R5 of the connecting between the hinge point at the upper end of the second transition straight rod 422 and the second transition hinge point, and the length R6 of the connecting between the second transition hinge point and the second middle hinge point satisfy following formula: $R4>R5$, and $R4>R6$.

With reference to the seat frame 100 shown in FIG. 1 to FIG. 7 as an example, and referring to FIG. 2, when the seat frame 100 is in the leisure position. A horizontal distance from the hinge point between the back pole frame 33 and the back rest mounting part 22 to the hinge point between the hip and leg support portion 21 and the first rocking rod 51 is defined as XL. A horizontal distance from the hinge point between the back pole frame 33 and the back rest mounting part 22 to the hinge point between the hip and leg support portion 21 and the second rocking rod 52 is defined as Y1. The horizontal distance X1 from the hinge point between the back pole frame 33 and the back rest mounting part 22 to the hinge point between the hip and leg support portion 21 and the first rocking rod 51 is 450 mm. The horizontal distance Y1 from the hinge point between the back pole frame 33 and the back rest mounting part 22 to the hinge point between the hip and leg support portion 21 and the second rocking rod 52 is 213 mm.

Referring to FIG. 3, when the seat frame 100 is in the leisure position. A horizontal distance from the hinge point between the back pole frame 33 and the back rest mounting part 22 to the hinge point between the hip and leg support portion 21 and the first rocking rod 51 is defined as XL. A horizontal distance from the hinge point between the back pole frame 33 and the back rest mounting part 22 to the hinge point between the hip and leg support portion 21 and the second rocking rod 52 is defined as Y1. The horizontal distance X1 from the hinge point between the back pole frame 33 and the back rest mounting part 22 to the hinge point between the hip and leg support portion 21 and the first rocking rod 51 is 411 mm. The horizontal distance Y1 from the hinge point between the back pole frame 33 and the back rest mounting part 22 to the hinge point between the hip and leg support portion 21 and the second rocking rod 52 is 174 mm.

It can be seen that both the seat cushion 20 and the polygonal planar structure 30 move forward to different degrees relative to the frame 10 in a process of switching from the leisure position to the lying position. And the forward movement of the polygonal planar structure 30 is greater than that of the seat cushion 20. According to the above data, on the basis of the forward movement of the seat cushion 20, the polygonal planar structure 30 moved forward by about 40 mm more than the seat cushion 20.

It can be seen that, compared with similar products in the related arts, the present disclosure has realized a great-scale forward movement of the polygonal planar structure 30. In the process of the seat frame 100 switching from the leisure position to the lying position, the forward movement of the polygonal planar structure 30 is significantly greater than that of the seat cushion 20. Especially, the forward movement of the back pole frame 33 is significantly greater than that of the seat cushion 20, thus eliminating a problem that a forward movement of the backrest lags behind that of the seat cushion 20. Therefore, during the switching to the lying position shown in FIG. 3, the body portion 331 of the back pole frame 33 can occupy the position below a waist of the user in time, thereby providing reliable support for the waist of the user, and avoiding an interference between the backrest and the wall caused by the backrest moving forward behind the seat cushion 20. Even if the back of the seat frame 100 including the backrest is placed adjacent to an indoor wall, the great forward movement of the polygonal planar structure 30 can still provide sufficient space for the backrest 33 to drive the backrest to rotate.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present disclosure.

One of ordinary skill in the art should recognize that the above embodiments are used only to illustrate the present disclosure and are not used to limit the present disclosure, and that appropriate variations and improvements to the above embodiments fall within the protection scope of the present disclosure so long as they are made without departing from the substantial spirit of the present disclosure.

What is claimed is:

1. A seat frame, comprising a frame, a seat cushion suspended above the frame and movably connected to the frame, and a backrest connecting rod mechanism with a polygonal planar structure, wherein the polygonal planar structure comprises:

a front swing arm, wherein the seat cushion is hinged between an upper end of the front swing arm and a lower end of the front swing arm;

a back pole frame, wherein a front end of the back pole frame is hinged to the upper end of the front swing arm; and a T-shaped connecting rod, wherein the T-shaped connecting rod comprises two straight rods which are hinged to each other, and an included angle between the two straight rods can be adjusted;

wherein an end of one of the two straight rods is defined as a first protruding end hinged to the lower end of the front swing arm, and an end of the other of the two straight rods is defined as a second protruding end hinged to a back end of the back pole frame, and one of the two straight rods comprises a top end movably connected to the frame; and the seat cushion is capable of moving relative to the frame along a preset trajectory in a plane parallel to the polygonal planar structure.

2. The seat frame of claim 1, wherein the two straight rods are denoted as:

a first micro-motion lever frame, wherein a front end of the first micro-motion lever frame is defined as the first protruding end, and a back end of the first micro-motion lever frame is defined as the top end; and a first back swing arm, wherein an upper end of the first back swing arm is defined as the second protruding end, and a lower end of the first back swing arm is hinged between the front end of the first micro-motion lever frame and the back end of the first micro-motion lever frame.

3. The seat frame of claim 2, wherein the backrest connecting rod mechanism further comprises a V-shaped connecting structure, the V-shaped connecting structure comprises:

a lower swing arm, wherein the lower swing arm is hinged to the frame; and a first transition straight rod, wherein a lower end of the first transition straight rod is hinged to the lower swing arm, and an upper end of the first transition straight rod is hinged to the seat cushion; and the back end of the first micro-motion lever frame is hinged between the upper end of the first transition straight rod and the lower end of the first transition straight rod.

4. The seat frame of claim 3, wherein the first micro-motion lever frame and the first transition straight rod are hinged at a first transition hinge point; and the first transition hinge point, a hinge point at the lower end of the first back swing arm, a hinge point at the upper end of the first back swing arm and a hinge point at the upper end of the first transition straight rod are connected in sequence to form a quadrilateral parallel to the polygonal planar structure.

5. The seat frame of claim 4, wherein the first back swing arm and the first micro-motion lever frame are hinged at a first middle hinge point, wherein a distance between the first middle hinge point and the hinge point at the front end of the first micro-motion lever frame is defined as S1, a distance between the first middle hinge point and the hinge point at the back end of the first micro-motion lever frame is defined as S2, and the distance S1 between the first middle hinge point and the hinge point at the front end of the first micro-motion lever frame and the distance S2 between the first middle hinge point and the hinge point at the back end of the first micro-motion lever frame satisfy following formula: $S1>S2$; and/or, a distance between the first transition hinge point and the hinge point at the upper end of the first transition straight rod is defined as Q1, and a distance between the first transition hinge point and the hinge point at the lower end of the first transition straight rod is defined as Q2, and the distance Q1 between the first transition hinge point and the hinge point at the upper end of the first transition straight rod and the distance Q2 between the first transition hinge point and the hinge point at the lower end of the first transition straight rod satisfy following formula: $Q1<Q2$; and/or, a length of a connecting line between the hinge point of the upper end of the first back swing arm and the hinge point of the lower end of the first back swing arm is defined as R1, a length of a connecting line between the hinge point at the upper end of the first transition straight rod and the first transition hinge point is defined as R2, a length of a connecting line between the first transition hinge point and the first middle hinge point is defined as R3, the length R1 of the connecting line between the hinge point of the upper end of the first back swing arm and the hinge point of the lower end of the first back swing arm, the length R2 of the connecting line between the hinge point at the upper end of the first transition straight rod and the first transition hinge point, and the length R3 of the connecting line between the first transition hinge point and the first middle hinge point satisfy following formula: $R1>R2$, and $R1>R3$.

6. The seat frame of claim 3, wherein the seat frame further comprises a telescopic connecting rod mechanism and a spring, and the telescopic connecting rod mechanism comprises:

a first rocking rod, wherein an upper end of the first rocking rod is hinged to the seat cushion;

a second rocking rod, an upper end of which is hinged to the seat cushion;

a sliding connecting rod, wherein a lower end of the first rocking rod and a lower end of the second rocking rod are hinged to the sliding connecting rod;

a first swing rod, wherein a lower end of the first swing rod is hinged to the frame;

a second swing rod, wherein a lower end of the second swing rod is hinged to the frame;

a third transmission rod, wherein an upper end of the first swing rod and an upper end of the second swing rod are hinged to the third transmission rod;

a first transmission rod, wherein an upper end of the first transmission rod is hinged between the upper end of the first swing rod and the lower end of the first swing rod;

a second transmission rod, wherein an upper end of the second transmission rod is hinged between the upper end of the second swing rod and the lower end of the second swing rod;

a fourth transmission rod, wherein a front end of the fourth transmission rod is hinged to the first swing rod, and a back end of the fourth transmission rod is hinged between the upper end of the second transmission rod and a lower end of the second transmission rod;

a first auxiliary rod, wherein the first auxiliary rod is hinged between the upper end of the first transmission rod and a lower end of the first transmission rod, and hinged at the lower end of the second transmission rod;

a second auxiliary rod, wherein an upper end of the second auxiliary rod is hinged to the first auxiliary rod, and a lower end of the second auxiliary rod is hinged to the sliding connecting rod;

a third auxiliary rod, wherein an upper end of the third auxiliary rod is hinged to the first auxiliary rod, and a lower end of the third auxiliary rod is hinged to the sliding connecting rod;

a fourth auxiliary rod, wherein a front end of the fourth auxiliary rod is hinged to the lower end of the first transmission rod, and a back end of the fourth auxiliary rod is hinged between the upper end of the third auxiliary rod and the lower end of the third auxiliary rod; and two ends of the spring are connected to the V-shaped connecting structure and the sliding connecting rod, respectively.

7. The seat frame of claim 1, wherein the two straight rods are denoted as:

a second back swing arm, wherein an upper end of the second back swing arm is defined as the second protruding end, and a lower end of the second back swing arm is defined as the top end; and a second micro-motion lever frame, wherein a front end of the second micro-motion lever frame is defined as the first protruding end, and a back end of the second micro-motion lever frame is hinged between the upper end of the second back swing arm and the lower end of the second back swing arm.

8. The seat frame of claim 7, wherein the backstreet connecting rod mechanism further comprises a V-shaped connecting structure, the V-shaped connecting structure comprises:

a lower swing arm, wherein the lower swing arm is hinged to the frame; and a second transition straight rod, wherein a lower end of the second transition straight rod is hinged to the lower swing arm, and an upper end of the second transition straight rod is hinged to the seat cushion;

the lower end of the second back swing arm is hinged between the upper end of the second transition straight rod and the lower end of the second transition straight rod.

9. The seat frame of claim 8, wherein the second back swing arm and the second transition straight rod are hinged at a second transition hinge point; and the second transition hinge point, a hinge point of the upper end of the second transition straight rod, a hinge point of the upper end of the second back swing arm and a hinge point of the back end of the second micro-motion lever frame are connected in sequence to form a quadrilateral parallel to the polygonal planar structure.

10. The seat frame of claim 9, wherein the second back swing arm and the second micro-motion lever frame are hinged at a second middle hinge point, wherein:

a distance between the second transition hinge point and the hinge point at the upper end of the second transition straight rod is defined as Q3, and a distance between the second transition hinge point and the hinge point at the lower end of the second transition straight rod is defined as Q4, and the distance Q3 between the second transition hinge point and the hinge point at the upper end of the second transition straight rod and the distance Q4 between the second transition hinge point and the hinge point at the lower end of the second transition straight rod satisfy following formula: $Q3<Q4$; and/or, a distance between the second middle hinge point and the hinge point at the upper end of the second back swing arm is defined as S3, a distance between the second middle hinge point and the hinge point at the lower end of the second back swing arm is defined as S4, and the distance S3 between the second middle hinge point and the hinge point at the upper end of the second back swing arm and the distance S4 between the second middle hinge point and the hinge point at the lower end of the second back swing arm satisfy following formula: $S3>S4$; and/or, a length of a connecting line between the hinge point at the front end of the second micro-motion lever frame and the hinge point at the back end of the second micro-motion lever frame is defined as R4, a length of a connecting between the hinge point at the upper end of the second transition straight rod and the second transition hinge point is defined as R5, a length of a connecting between the second transition hinge point and the second middle hinge point is defined as R6, and the length R4 of the connecting line between the hinge point at the front end of the second micro-motion lever frame and the hinge point at the back end of the second micro-motion lever frame, the length R5 of the connecting between the hinge point at the upper end of the second transition straight rod and the second transition hinge point, and the length R6 of the connecting between the second transition hinge point and the second middle hinge point satisfy following formula: $R4>R5$, and $R4>R6$.

11. The seat frame of claim 8, wherein the seat frame further comprises a telescopic connecting rod mechanism and a spring, and the telescopic connecting rod mechanism comprises:

a first rocking rod, wherein an upper end of the first rocking rod is hinged to the seat cushion;

a second rocking rod, an upper end of which is hinged to the seat cushion;

a sliding connecting rod, wherein a lower end of the first rocking rod and a lower end of the second rocking rod are hinged to the sliding connecting rod;

a first swing rod, wherein a lower end of the first swing rod is hinged to the frame;

a second swing rod, wherein a lower end of the second swing rod is hinged to the frame;

a third transmission rod, wherein an upper end of the first swing rod and an upper end of the second swing rod are hinged to the third transmission rod;

a first transmission rod, wherein an upper end of the first transmission rod is hinged between the upper end of the first swing rod and the lower end of the first swing rod;

a second transmission rod, wherein an upper end of the second transmission rod is hinged between the upper end of the second swing rod and the lower end of the second swing rod;

a fourth transmission rod, wherein a front end of the fourth transmission rod is hinged to the first swing rod, and a back end of the fourth transmission rod is hinged between the upper end of the second transmission rod and a lower end of the second transmission rod;

a first auxiliary rod, wherein the first auxiliary rod is hinged between the upper end of the first transmission rod and a lower end of the first transmission rod, and hinged at the lower end of the second transmission rod;

a second auxiliary rod, wherein an upper end of the second auxiliary rod is hinged to the first auxiliary rod, and a lower end of the second auxiliary rod is hinged to the sliding connecting rod;

a third auxiliary rod, wherein an upper end of the third auxiliary rod is hinged to the first auxiliary rod, and a lower end of the third auxiliary rod is hinged to the sliding connecting rod;

a fourth auxiliary rod, wherein a front end of the fourth auxiliary rod is hinged to the lower end of the first transmission rod, and a back end of the fourth auxiliary rod is hinged between the upper end of the third auxiliary rod and the lower end of the third auxiliary rod; and two ends of the spring are connected to the V-shaped connecting structure and the sliding connecting rod, respectively.

12. A seat with switchable sitting and lying positions, comprising the seat frame of claim 1.

13. The seat of claim 12, wherein the two straight rods are denoted as:

a first micro-motion lever frame, wherein a front end of the first micro-motion lever frame is defined as the first protruding end, and a back end of the first micro-motion lever frame is defined as the top end; and a first back swing arm, wherein an upper end of the first back swing arm is defined as the second protruding end, and a lower end of the first back swing arm is hinged between the front end of the first micro-motion lever frame and the back end of the first micro-motion lever frame.

14. The seat of claim 13, wherein the backrest connecting rod mechanism further comprises a V-shaped connecting structure, the V-shaped connecting structure comprises:

a lower swing arm, wherein the lower swing arm is hinged to the frame; and a first transition straight rod, wherein a lower end of the first transition straight rod is hinged to the lower swing arm, and an upper end of the first transition straight rod is hinged to the seat cushion; and the back end of the first micro-motion lever frame is hinged between the upper end of the first transition straight rod and the lower end of the first transition straight rod.

15. The seat of claim 14, wherein the first micro-motion lever frame and the first transition straight rod are hinged at a first transition hinge point; and the first transition hinge point, a hinge point at the lower end of the first back swing arm, a hinge point at the upper end of the first back swing arm and a hinge point at the upper end of the first transition straight rod are connected in sequence to form a quadrilateral parallel to the polygonal planar structure.

16. The seat of claim 15, wherein the first back swing arm and the first micro-motion lever frame are hinged at a first middle hinge point, wherein a distance between the first middle hinge point and the hinge point at the front end of the first micro-motion lever frame is defined as S1, a distance between the first middle hinge point and the hinge point at the back end of the first micro-motion lever frame is defined as S2, and the distance S1 between the first middle hinge point and the hinge point at the front end of the first micro-motion lever frame and the distance S2 between the first middle hinge point and the hinge point at the back end of the first micro-motion lever frame satisfy following formula: $S1>S2$; and/or, a distance between the first transition hinge point and the hinge point at the upper end of the first transition straight rod is defined as Q1, and a distance between the first transition hinge point and the hinge point at the lower end of the first transition straight rod is defined as Q2, and the distance Q1 between the first transition hinge point and the hinge point at the upper end of the first transition straight rod and the distance Q2 between the first transition hinge point and the hinge point at the lower end of the first transition straight rod satisfy following formula: $Q1<Q2$; and/or, a length of a connecting line between the hinge point of the upper end of the first back swing arm and the hinge point of the lower end of the first back swing arm is defined as R1, a length of a connecting line between the hinge point at the upper end of the first transition straight rod and the first transition hinge point is defined as R2, a length of a connecting line between the first transition hinge point and the first middle hinge point is defined as R3, the length R1 of the connecting line between the hinge point of the upper end of the first back swing arm and the hinge point of the lower end of the first back swing arm, the length R2 of the connecting line between the hinge point at the upper end of the first transition straight rod and the first transition hinge point, and the length R3 of the connecting line between the first transition hinge point and the first middle hinge point satisfy following formula: $R1>R2$, and $R1>R3$.

17. The seat of claim 12, wherein the two straight rods are denoted as:

a second back swing arm, wherein an upper end of the second back swing arm is defined as the second protruding end, and a lower end of the second back swing arm is defined as the top end; and a second micro-motion lever frame, wherein a front end of the second micro-motion lever frame is defined as the first protruding end, and a back end of the second micro-motion lever frame is hinged between the upper end of the second back swing arm and the lower end of the second back swing arm.

18. The seat of claim 17, wherein the backstreet connecting rod mechanism further comprises a V-shaped connecting structure, the V-shaped connecting structure comprises:

a lower swing arm, wherein the lower swing arm is hinged to the frame; and a second transition straight rod, wherein a lower end of the second transition straight rod is hinged to the lower swing arm, and an upper end of the second transition straight rod is hinged to the seat cushion;

the lower end of the second back swing arm is hinged between the upper end of the second transition straight rod and the lower end of the second transition straight rod.

19. The seat of claim 18, wherein the second back swing arm and the second transition straight rod are hinged at a second transition hinge point; and the second transition hinge point, a hinge point of the upper end of the second transition straight rod, a hinge point of the upper end of the second back swing arm and a hinge point of the back end of the second micro-motion lever frame are connected in sequence to form a quadrilateral parallel to the polygonal planar structure.

20. The seat of claim 19, wherein the second back swing arm and the second micro-motion lever frame are hinged at a second middle hinge point, wherein:

a distance between the second transition hinge point and the hinge point at the upper end of the second transition straight rod is defined as Q3, and a distance between the second transition hinge point and the hinge point at the lower end of the second transition straight rod is defined as Q4, and the distance Q3 between the second transition hinge point and the hinge point at the upper end of the second transition straight rod and the distance Q4 between the second transition hinge point and the hinge point at the lower end of the second transition straight rod satisfy following formula: $Q3<Q4$; and/or, a distance between the second middle hinge point and the hinge point at the upper end of the second back swing arm is defined as S3, a distance between the second middle hinge point and the hinge point at the lower end of the second back swing arm is defined as S4, and the distance S3 between the second middle hinge point and the hinge point at the upper end of the second back swing arm and the distance S4 between the second middle hinge point and the hinge point at the lower end of the second back swing arm satisfy following formula: $S3>S4$; and/or, a length of a connecting line between the hinge point at the front end of the second micro-motion lever frame and the hinge point at the back end of the second micro-motion lever frame is defined as R4, a length of a connecting between the hinge point at the upper end of the second transition straight rod and the second transition hinge point is defined as R5, a length of a connecting between the second transition hinge point and the second middle hinge point is defined as R6, and the length R4 of the connecting line between the hinge point at the front end of the second micro-motion lever frame and the hinge point at the back end of the second micro-motion lever frame, the length R5 of the connecting between the hinge point at the upper end of the second transition straight rod and the second transition hinge point, and the length R6 of the connecting between the second transition hinge point and the second middle hinge point satisfy following formula: $R4>R5$, and $R4>R6$.

* * * * *